US007096780B1

(12) United States Patent
Hawkins

(10) Patent No.: US 7,096,780 B1
(45) Date of Patent: Aug. 29, 2006

(54) TOP LOADING, AUTOMATICALLY COMPACTING TRASH CAN FOR HIGH-TRAFFIC PUBLIC VENUES

(76) Inventor: Bobby L. Hawkins, 4 New Circle Rd., Travelers Rest, SC (US) 29690

( * ) Notice: Subject to any disclaimer, the term of this patent is extended or adjusted under 35 U.S.C. 154(b) by 220 days.

(21) Appl. No.: 10/725,228

(22) Filed: Dec. 1, 2003

Related U.S. Application Data

(63) Continuation-in-part of application No. 10/012,373, filed on Oct. 30, 2001, now Pat. No. 6,701,832.

(51) Int. Cl.
*B30B 15/30* (2006.01)

(52) U.S. Cl. ..... 100/215; 100/49; 100/99; 100/229 A; 100/233

(58) Field of Classification Search ..... 100/48, 100/49, 52, 214, 215, 216, 226, 229 R, 229 A, 100/233, 99; 220/908; 232/44, 47, 53
See application file for complete search history.

(56) References Cited

U.S. PATENT DOCUMENTS

| | | | | |
|---|---|---|---|---|
| 2,968,235 | A * | 1/1961 | Marica | 100/218 |
| 3,901,139 | A | 8/1975 | Moriconi | |
| 4,130,054 | A * | 12/1978 | Tashman | 100/52 |
| 4,147,100 | A | 4/1979 | Dykstra | |
| 4,432,278 | A | 2/1984 | Skipworth | |
| 4,552,061 | A | 11/1985 | Brutsman | |
| 4,559,870 | A | 12/1985 | Krummacher et al. | |
| 4,638,730 | A | 1/1987 | Bonacorsi | |
| 4,870,898 | A | 10/1989 | Spencer | |
| 4,896,593 | A | 1/1990 | Slusser | |
| RE33,527 | E | 1/1991 | Fox | |
| 4,991,500 | A | 2/1991 | Knapp | |
| 5,001,977 | A | 3/1991 | Tracy | |
| 5,012,732 | A | 5/1991 | Fox | |
| 5,025,719 | A | 6/1991 | Thomas | |
| 5,042,374 | A | 8/1991 | Klepacki | |
| 5,263,412 | A | 11/1993 | Chenard et al. | |
| 5,307,607 | A | 5/1994 | Tondo | |
| 5,465,660 | A | 11/1995 | Conti et al. | |
| 5,517,907 | A | 5/1996 | Fox | |
| 5,619,915 | A | 4/1997 | Wagner et al. | |
| 5,690,025 | A | 11/1997 | Hawkins | |
| 5,752,439 | A | 5/1998 | LaMora, Jr. | |
| 5,816,145 | A | 10/1998 | Lackner | |
| 5,845,567 | A | 12/1998 | Fischer | |
| 5,884,556 | A | 3/1999 | Klepacki et al. | |
| 6,701,832 | B1 * | 3/2004 | Hawkins | 100/49 |

* cited by examiner

*Primary Examiner*—Derris H. Banks
*Assistant Examiner*—Jimmy T. Nguyen
(74) *Attorney, Agent, or Firm*—Dority & Manning, P.A.

(57) ABSTRACT

The present invention contemplates a trash can that one finds in high-traffic public venues. The trash can receives trash through an opening in the top of the housing. A trash by-pass chute is disposed within the housing and transports the trash from the opening in the top to the lower portion of the housing. A compacting mechanism is provided for automatically compacting the trash in the lower portion of the housing. Access to the trash by-pass chute is controlled by a hatch that can be closed by activation of a hatch stop. An actuator automatically activates the hatch stop during operation of the compacting mechanism. The compacted trash may be removed from the lower portion of the housing via a door that opens to allow access through the side of the trash can. The mechanism for compacting trash contents is automatically disabled if the door is open. A controller operates in conjunction with non-contact magnetic sensors to control operation of the trash can. A method is provided of forming a fiberglass item that includes an embedded image that can be cleaned without degrading the appearance of the image.

13 Claims, 19 Drawing Sheets

121
122
120
122

123
120
124
124

125
128a
124
120

122
127
125
122
120
126

125
128b
126
120

129
120
130
126

130
120
132
131

134
120
135

134
126
133
126
130

TOP LOADING, AUTOMATICALLY COMPACTING TRASH CAN FOR HIGH-TRAFFIC PUBLIC VENUES

CROSS-REFERENCE TO RELATED APPLICATIONS

This application is a continuation-in-part application to commonly owned U.S. application Ser. No. 10/012,373, filed Oct. 30, 2001, now U.S. Pat. No. 6,701,832.

STATEMENT REGARDING FEDERALLY SPONSORED RESEARCH OR DEVELOPMENT

N/A

BACKGROUND OF THE INVENTION

Trash compactors sized for consumer use include a trash receptacle open at the top and disposed beneath a platen that can be lowered into the trash receptacle to compress the trash. U.S. Pat. No. 5,690,025, which is hereby incorporated herein by this reference, discloses a typical compactor that includes a housing with a trash opening 20 that is disposed through the side of the housing. The trash opening 20 is disposed at a height that is higher than the opening of the trash receptacle and lower than the retracted height of the platen. In this way, trash entering the compactor enters in a space disposed between the retracted height of the platen and the open top of the trash receptacle.

In some compactor embodiments such as disclosed in U.S. Pat. No. 4,870,898 to Spencer and U.S. Pat. No. 5,517,907 to Fox, which are hereby incorporated herein by this reference, the platen includes a portion that pivots with its free edge upwardly away from the opening of the trash receptacle and above the height of the trash opening 20 in the sidewall 18 of the housing.

Trash cans located on the premises of public venues such as airport terminals for example, include a housing that surrounds a trash receptacle. The housing typically includes a removable top that has an opening disposed above the opening of the trash receptacle. In some embodiments, the opening in the top of the housing can be provided with a spring-loaded closure that biases the closure in a position that seals and closes the opening in the top. When these trash cans become full, an attendant must remove the top of the housing and empty the contents into a larger bin for transport to a collection site from which the trash is removed from the premises to a disposal facility. The type of trash that the public disposes in the trash can typically occupied a relatively large volume and low density, as it consists largely of items such as beverage cans, cups composed of plastic or styrofoam, papers, and the like. Because this type of trash occupies a relatively large volume for its weight, attendants must frequently empty the trash receptacle to prevent the trash from overflowing the receptacle and clogging the opening in the top of the housing of the trash can. Because of the volume of trash in each trash can, a single attendant cannot empty very many trash cans in a single circuit of the attendant's assigned area. This disability limits the number of trash cans that can be monitored by any one attendant during the time span in which each can is expected to become full.

OBJECTS AND SUMMARY OF THE INVENTION

It is a principal object of the present invention to provide a trash can for high traffic public areas.

It is another principal object of the present invention to provide a trash can for high traffic public areas with an opening through the top of the trash can and means for periodically and automatically compacting the trash.

It is an additional principal object of the present invention to provide a trash can with an opening through the top having a hatch that can be positively locked in place by a cable actuator system to prevent persons from putting their hands through the opening during operation of the means for periodically and automatically compacting the trash.

It is a further principal object of the present invention to provide for high traffic public areas, a trash can with an opening through the top and means for periodically and automatically compacting the trash wherein a lockable hatch is provided with a configuration that admits passage of liquids and smaller volume items without requiring movement of the hatch.

It is yet another principal object of the present invention to provide a top loading trash can with a compacting mechanism that includes a platen that has a portion that is pivotable out of the way of the path of trash entering the housing from the top and falling into the opening of the trash receptacle yet covers substantially all of the trash to be compacted during the compaction stroke.

It is a still further principal object of the present invention to provide a trash can for high traffic public areas with means for periodically and automatically compacting the trash wherein non-contact sensors are used in controlling the activation of the compacting cycle and detecting when the can is full and needs emptying.

It is yet another principal object of the present invention to provide a method for making a fiberglass housing for a trash can for high traffic public areas with graphics that do not degrade with repeated cleanings.

Additional objects and advantages of the invention will be set forth in part in the description that follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, a trash can that one finds in high-traffic public venues can includes a housing with an opening in the top of the housing. A trash by-pass chute is disposed within the housing and transports the trash from the opening in the top to the lower portion of the housing. A mechanism for automatically compacting the trash in the lower portion of the housing is provided within the housing. The mechanism for compacting trash contents can be carried by a frame disposed within the housing. The compacting mechanism can include a platen and can be configured for moving the platen through a compaction stroke to apply compacting pressure to trash contents located in the lower portion of the housing during at least a portion of a compaction stroke. The platen can include a pivotable portion that pivots to by-pass the trash by-pass chute during at least a portion of a retraction stroke of the compacting mechanism. The compacting mechanism desirably includes and is controlled by a programmable controller. A non-contact sensor can be disposed to detect when trash enters the trash by-pass chute and to report this information to the controller. The controller can be programmed to activate the trash compacting mechanism to compact the trash in the lower portion of the housing after the detector registers a predetermined number of times when trash enters the trash by-pass chute. A hatch can be provided to selectively block the entrance of the trash by-pass chute. A non-contact sensor can be provided to sense when the hatch is oriented in the closed or open position and to report this information to the controller. A hatch stop can be provided to selectively prevent the hatch from moving to allow trash or a person's hand to pass into the trash by-pass chute. A mechanical actuator mechanism can be provided to deploy the hatch stop automatically when the controller is operating the compacting mechanism. The compacted trash may be removed from the lower portion of the housing via a door that opens to allow access through the side of the trash can. A sensor can be provided and disposed to detect when the door is closed and locked and report this information to the controller, which can be programmed to prevent the trash compacting mechanism from operating unless the door is closed and locked. When the door is open, a switch can be provided to open and thereby deprive the trash compacting mechanism of the power needed to operate. A non-contact sensor can be provided to sense when enough compacted trash has been accumulated to warrant emptying the trash can and to report this information to the controller, which in turn signals for the attendant to remove the accumulated, compacted trash.

A message or other image can be displayed in a display panel that can be provided in the housing of the trash can in a manner that permits cleaning of the surface forming the image without degrading the appearance of the image. In further accordance with the present invention, a method is provided of forming a fiberglass item such as a housing for the trash can that includes such an embedded image that can be cleaned without degrading the appearance of the image.

The accompanying drawings, which are incorporated in and constitute a part of this specification, illustrate a presently preferred embodiment of the invention as well as some alternative embodiments. These drawings, together with the description, serve to explain the principles of the invention but by no means are intended to be exhaustive of all of the possible manifestations of the invention.

DETAILED DESCRIPTION OF THE PREFERRED EMBODIMENTS

Reference now will be made in detail to the presently preferred embodiments of the invention, one or more examples of which are illustrated in the accompanying drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. The same numerals are assigned to the same components throughout the drawings and description. While components of the invention are described below as desirably functioning in a particular way or as desirably formed or structured in a particular way, this is not intended to eliminate from the scope of the invention, alternative functioning, forming or structuring.

The present invention contemplates a trash can that looks for all the world like the type of trash cans that one finds in high-traffic public venues such as train stations, airports, department stores, shopping malls, food courts and the like. However, although the trash can receives trash through an opening in the top, the trash can contains a mechanism for automatically compacting the trash. Thus, the trash can holds more trash and requires less frequent emptying by attendants than a conventional can of comparable size. In accordance with the present invention, an apparatus for containing and compacting trash contents includes a housing, a frame disposed within the housing, a trash by-pass chute disposed within the housing and a compacting mechanism carried by the frame. A controller is connected to sensors that provide signals from which the controller determines when to activate the compacting mechanism and when to signal the attendant to remove the compacted trash that has been accumulated. The compacted trash may be removed from the lower portion of the housing via a door that opens to allow access through the side of the trash can.

Figure 1:
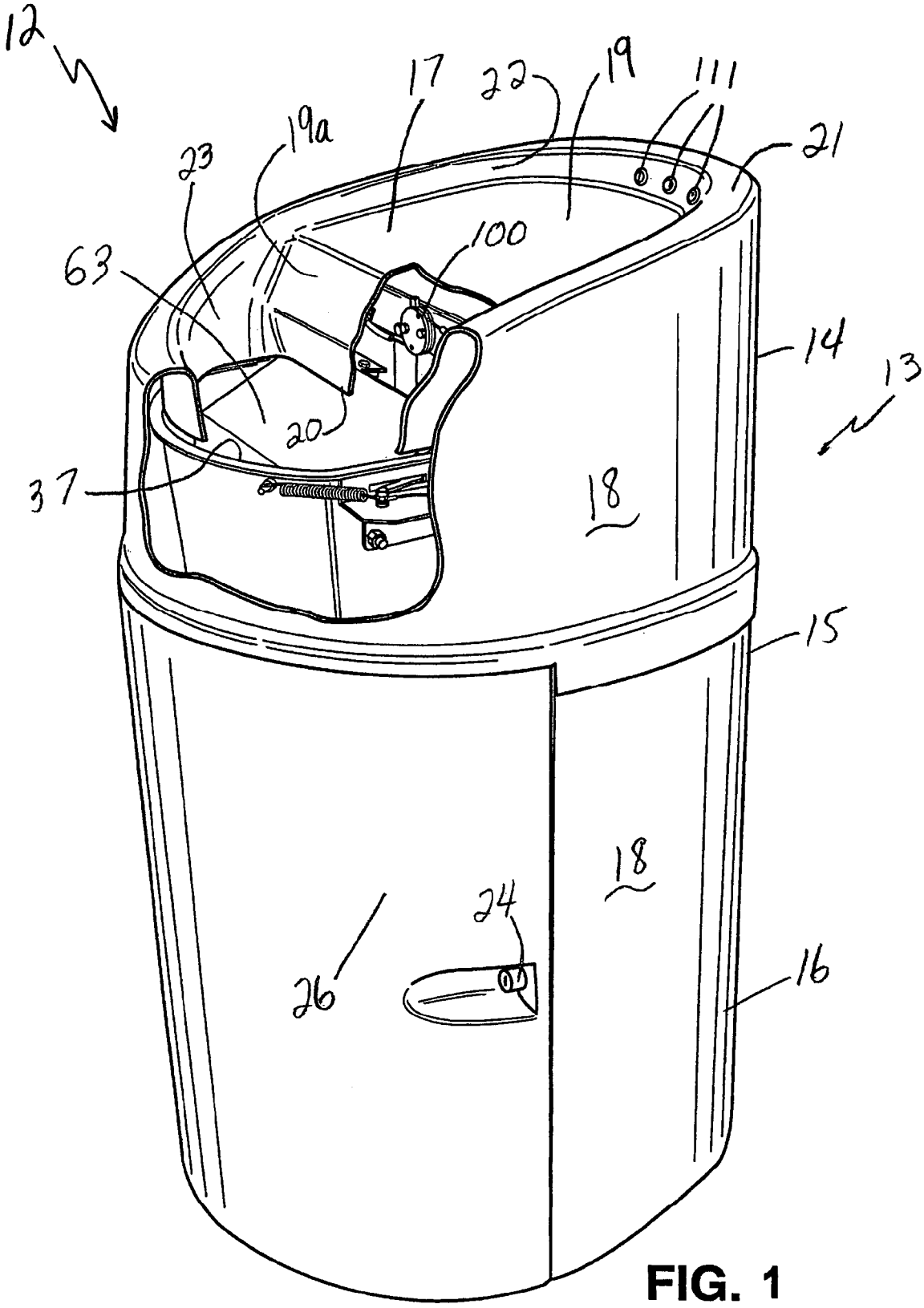
FIG. 1 is an elevated perspective view (with sections cut away) of a presently preferred embodiment of the top loading, automatically self-compacting trash can for high-traffic public venues in accordance with the present invention.
Figure 2:
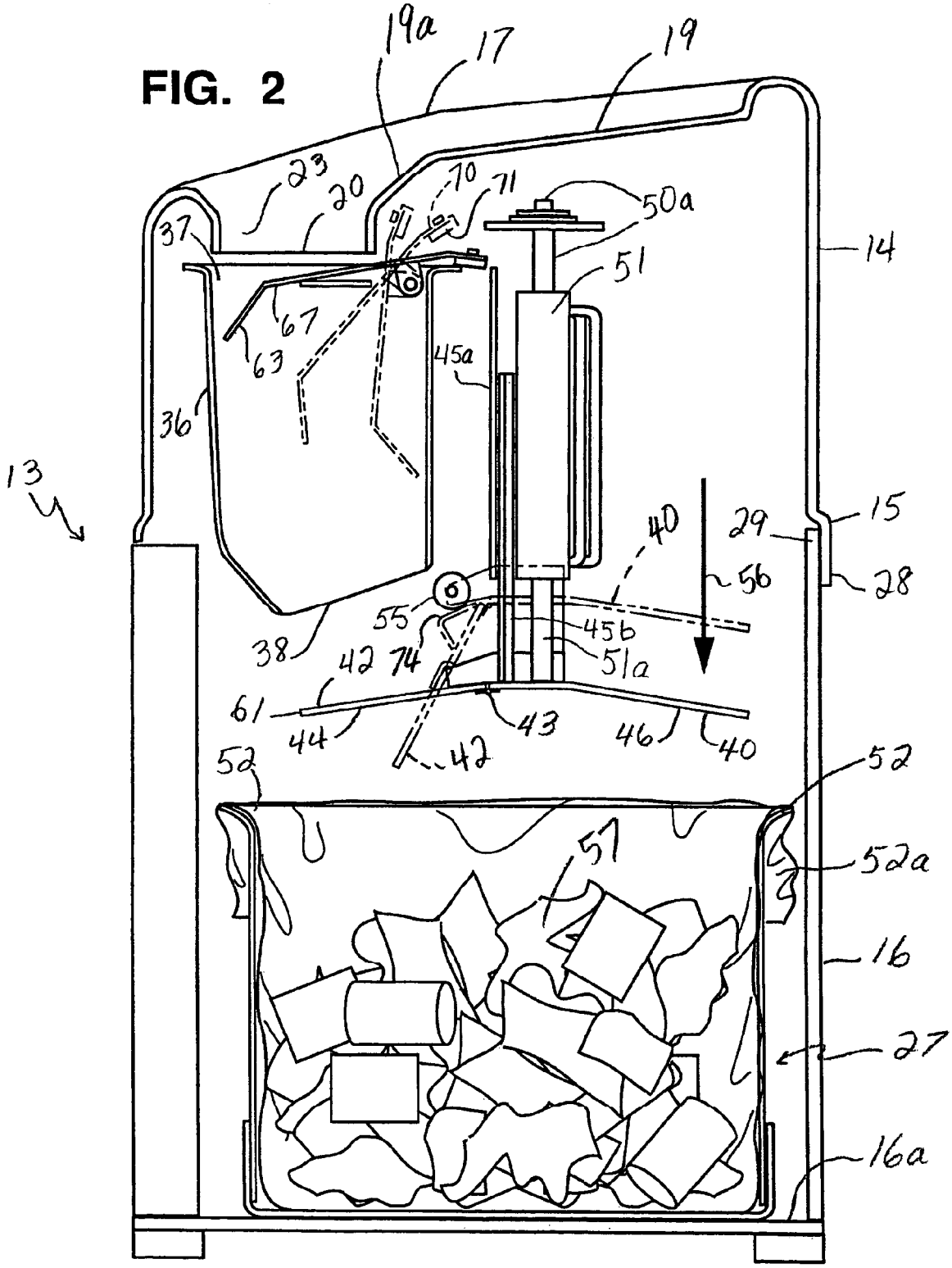
FIG. 2 is a cut-away side view (with some internal components schematically shown, some shown in chain dashed line to indicate different positions and some with sections cut away) of a presently preferred embodiment of the top loading, automatically self-compacting trash can for high-traffic public venues in accordance with the present invention.
Figure 3:
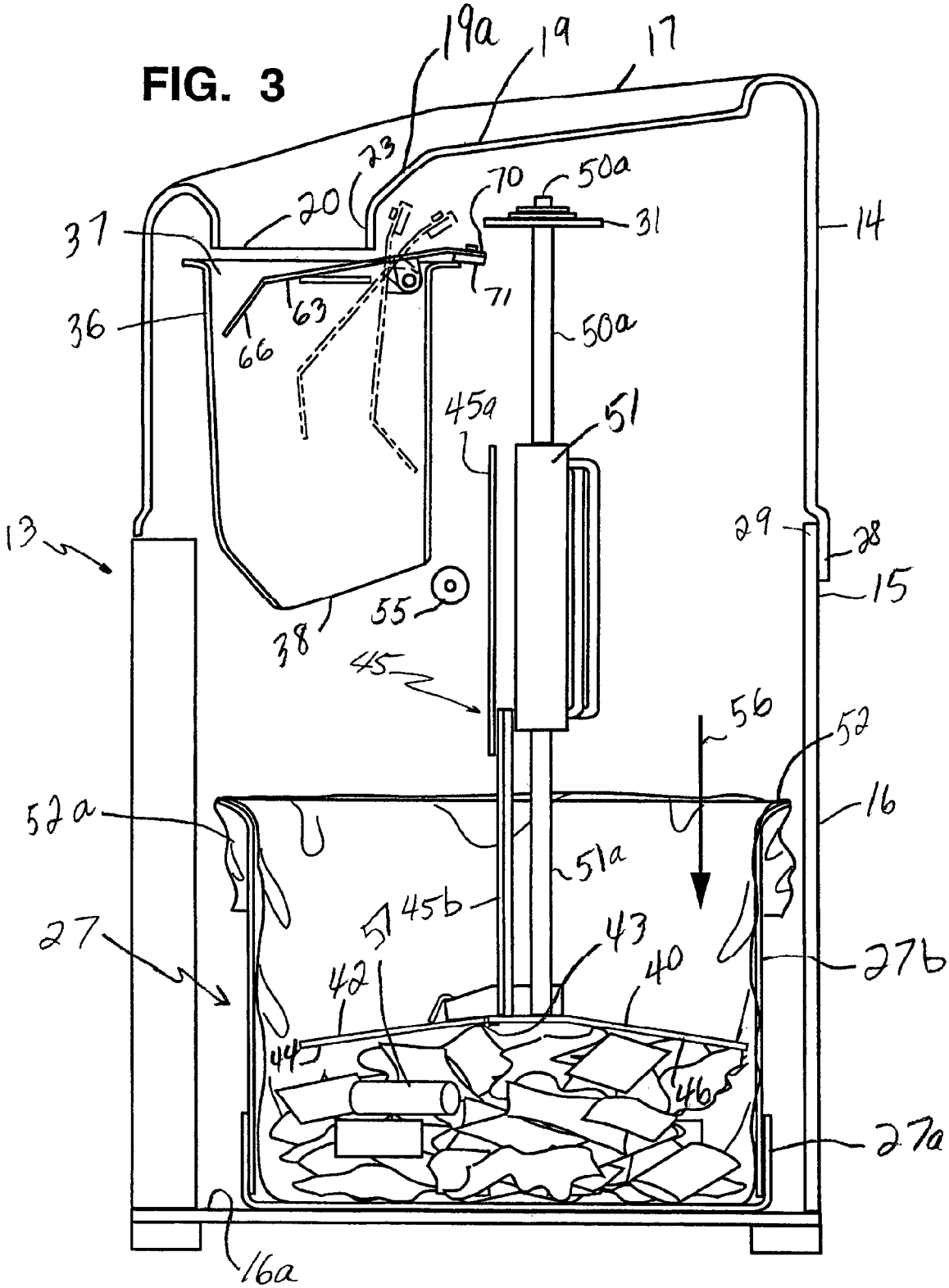
FIG. 3 is a cut-away side view (with some internal components schematically shown, some shown in chain dashed line to indicate different positions and some with sections cut away) of a presently preferred embodiment of the top loading, automatically self-compacting trash can for high-traffic public venues in accordance with the present invention.

A presently preferred embodiment of the inventive trash can is generally designated in FIG. 1 by the numeral 12. Trash can 12 includes an outer shell that forms a housing that is generally designated by the numeral 13. Part of shell 13 has been cut away in FIG. 1 to reveal some of the components that are disposed within the housing. As shown in FIGS. 1, 2 and 3 for example, the housing 13 includes an upper portion 14, a lower portion 16 and an intermediate portion 15 disposed between the upper portion 14 and the lower portion 16. As shown in FIGS. 1, 2 and 3 for example, the upper portion 14 is desirably selectively detachable and attachable to the lower portion 16 in the vicinity of the intermediate portion 15. As shown in FIGS. 2 and 3 for example, this can be effected by a frictional interfit whereby the leading edge 29 of a flange is received telescopically within the leading edge 28 of a mating flange. The opposite arrangement (leading edge 28 received within leading edge 29) is also possible, but is less desirable from both an aesthetic and functional standpoint. The ability of the upper portion 14 to detach from the lower portion 16 facilitates servicing of the mechanism inside the trash can, but is not required to empty the trash. However, in some embodiments, the upper portion 14 of the housing 13 can be formed as part of a unitary structure with the intermediate portion 15 of the housing.

The overall shape of the housing 12 can be formed in any manner that is deemed aesthetically desirable. In the presently preferred embodiment shown in FIG. 1, the housing 12 takes a generally circular cylindrical shape. The cylindrical shape minimizes the surface area of the housing for any given volume. However, the transverse cross section of the housing 12 could take on the shape of a square or other polygon or a combination of arcuate and flat surfaces and lines.

As shown in FIG. 1 for example, the housing 13 includes a top 17 and a sidewall 18 connected to the top. The top 17 extends generally transversely relative to the axial vertical direction in which the sidewall 18 of the housing 13 extends. The top 17 and an upper section of the sidewall 18 form the upper portion 14 of the housing 13. As shown in FIG. 1, the top 17 of the housing includes a top wall 19 that may be recessed from the upper edge 21 of the top 17 of the housing 13. Thus, the top 17 can include a peripheral lip 22 that is raised vertically above the level of the top wall 19.

As shown in FIGS. 1, 2 and 3 for example, a trash opening 20 is defined through a portion of the top wall 19 of the upper portion 14 of the housing 13. The shape of the trash opening 20 can be any shape that is desired. In the embodiment shown, the shape of the trash opening 20 resembles a half-circle.

As shown in FIG. 1, aligned with the trash opening 20, an axially extending funnel member 23 can be provided. A first end of the funnel 23 can be connected to and contiguous with the trash opening 20 in the top 17 of the housing 13. In the embodiment shown in FIG. 1, the shape of the trash opening 20 is imposed desirably on the funnel 23 that feeds into the trash opening 20. The funnel 23 functions to guide the trash before the trash enters the trash opening 20. As shown in FIGS. 1, 2 and 3 for example, the top wall 19 of the housing can be gently sloped toward the trash opening 20 and toward a more steeply sloping funnel 23 that leads directly to the trash opening 20. With the top wall 19 so inclined, trash placed on the top wall 19 of the housing 13 tends to feed toward the funnel 23 and the trash opening 20 under the influence of the force of gravity. The funnel 23 helps determine the directional momentum of the trash before the trash falls through the vertical drop that occurs within the upper portion 14 of the housing.

The upper portion 14 of the housing 13, which includes the top wall 19 of the housing, and the funnel 23 desirably can be formed as a unitary structure. However, in an alternative embodiment, different pieces can be joined to form the sidewall 18 of the housing, the top wall 19 and the funnel 23. The top wall 19, the funnel 23 and the sidewall 18 of the upper portion 14 of the housing 13 desirably can be formed from stamped metal or molded plastic or fiberglass, as desired.

As best seen in the view of FIG. 1 for example, the top wall 19 can include a display panel 19*a*, which desirably is projected at an angle that is easily observed by the casual passerby who is focusing on the trash opening 20 for purposes of depositing trash into the trash can 12. Display panel 19*a* provides a convenient surface for carrying a message such as "TRASH" that can be read easily by the passerby. While the display panel 19*a* shown in FIG. 1 is a flat rectangular surface that is tilted at approximately a 45° angle from the vertical, other configurations for display panel 19*a* can be used, as desired. The message carried by display panel 19*a* can be provided in a manner (explained below) that permits cleaning of the surface forming the display panel 19*a* without degrading the appearance of the message.

Figure 4:
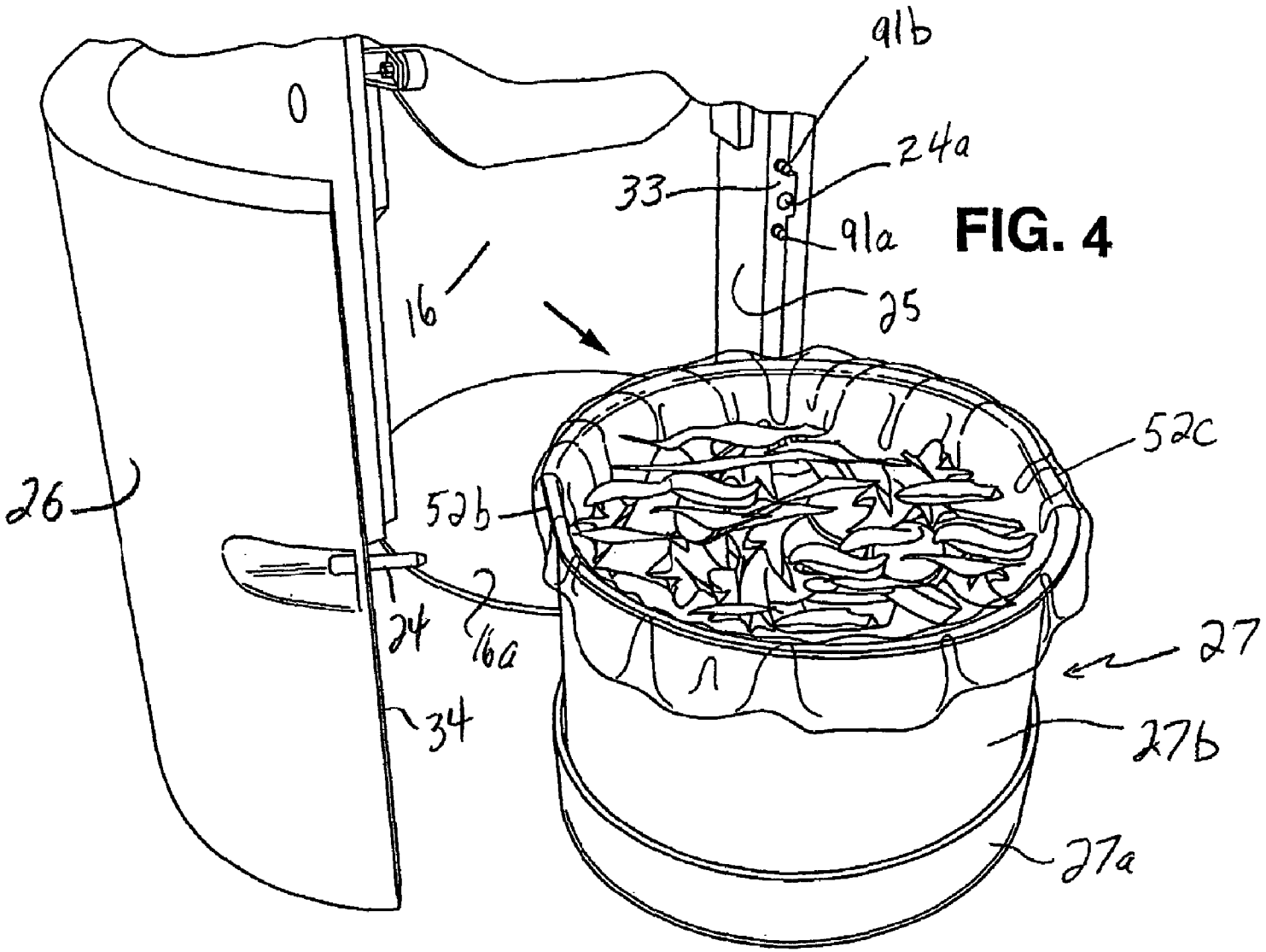
FIG. 4 is an elevated perspective view of components of a portion of the embodiment of FIG. 1.
Figure 5:
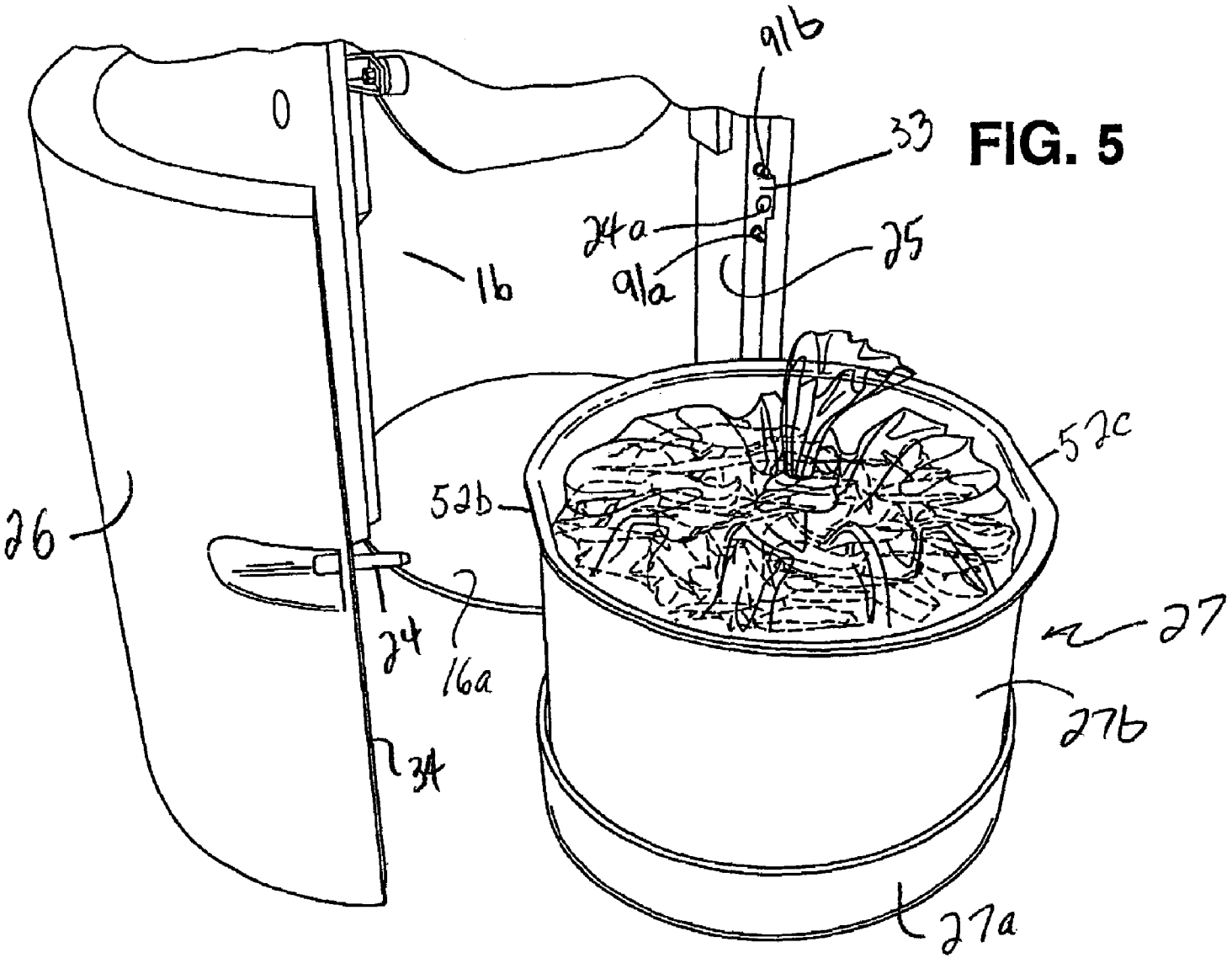
FIG. 5 is an elevated perspective view of components of a portion of the embodiment of FIG. 1.

As shown in FIGS. 4 and 5 for example, an access opening 25 is defined through the lower portion 16 of the housing 13. The lower portion 16 of the housing also is partly composed of a door 26 that is configured to selectively open and close the access opening 25. The door 26 is shown in FIG. 1 in solid line in its closed orientation and in FIGS. 4 and 5 in its open orientation. The door 26 can be hinged at one side as shown in FIG. 1. Alternatively, the door 26 can be a sliding door. With a housing that is shaped differently than the cylindrical shape shown in FIG. 1, other mechanisms for attaching the door 26 may lend themselves to take advantage of the alternative configurations of the shape of the housing. For example, where the transverse cross-sectional shape of the housing is in the form of a polygon, one of the facets of the polygon may define the door, which may be hinged at the top or the bottom if desired.

The door 26 is provided with a locking mechanism that functions to selectively secure the door 26 to the frame. As embodied herein and shown in FIGS. 4 and 5 for example, an edge 34 of the door 26 receives a bolt 24 that has a threaded free end and has a head on the opposite end that is configured with a hexagonal-shaped recess to receive therein an Allen wrench for example. A mating nut 24*a* having a threaded opening is mounted in a section 33 of the frame that is disposed to butt against the edge 34 of door 26 and is configured to mate with the threaded end of bolt 24. Other locking mechanisms can be provided for the door 26 so long as they somewhat limit access to the access opening 25 such as by requiring a special key (such as a tool like an Allen wrench) to be opened.

Figure 6:
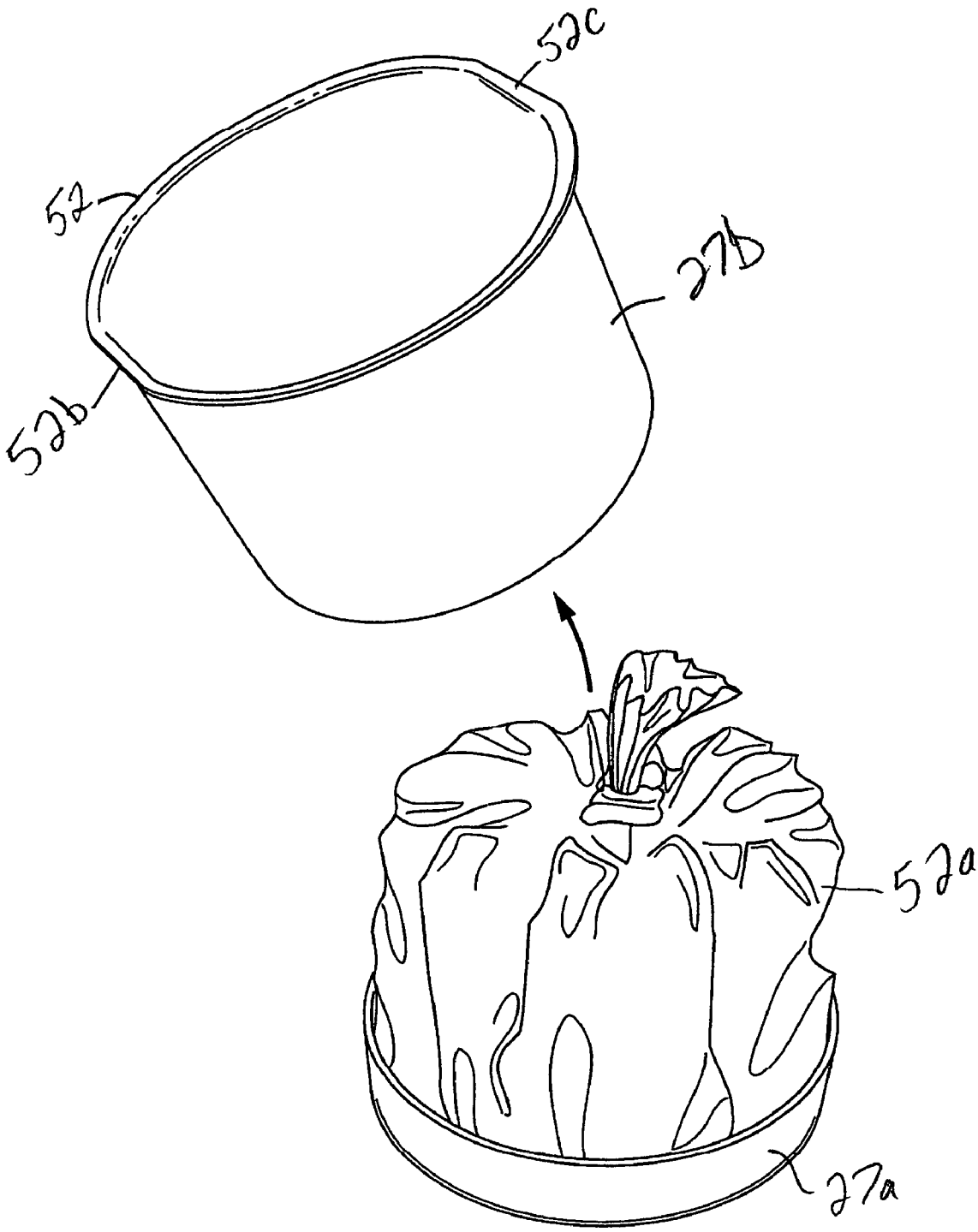
FIG. 6 is an elevated perspective view of components of the embodiment of FIG. 1.
Figure 7:
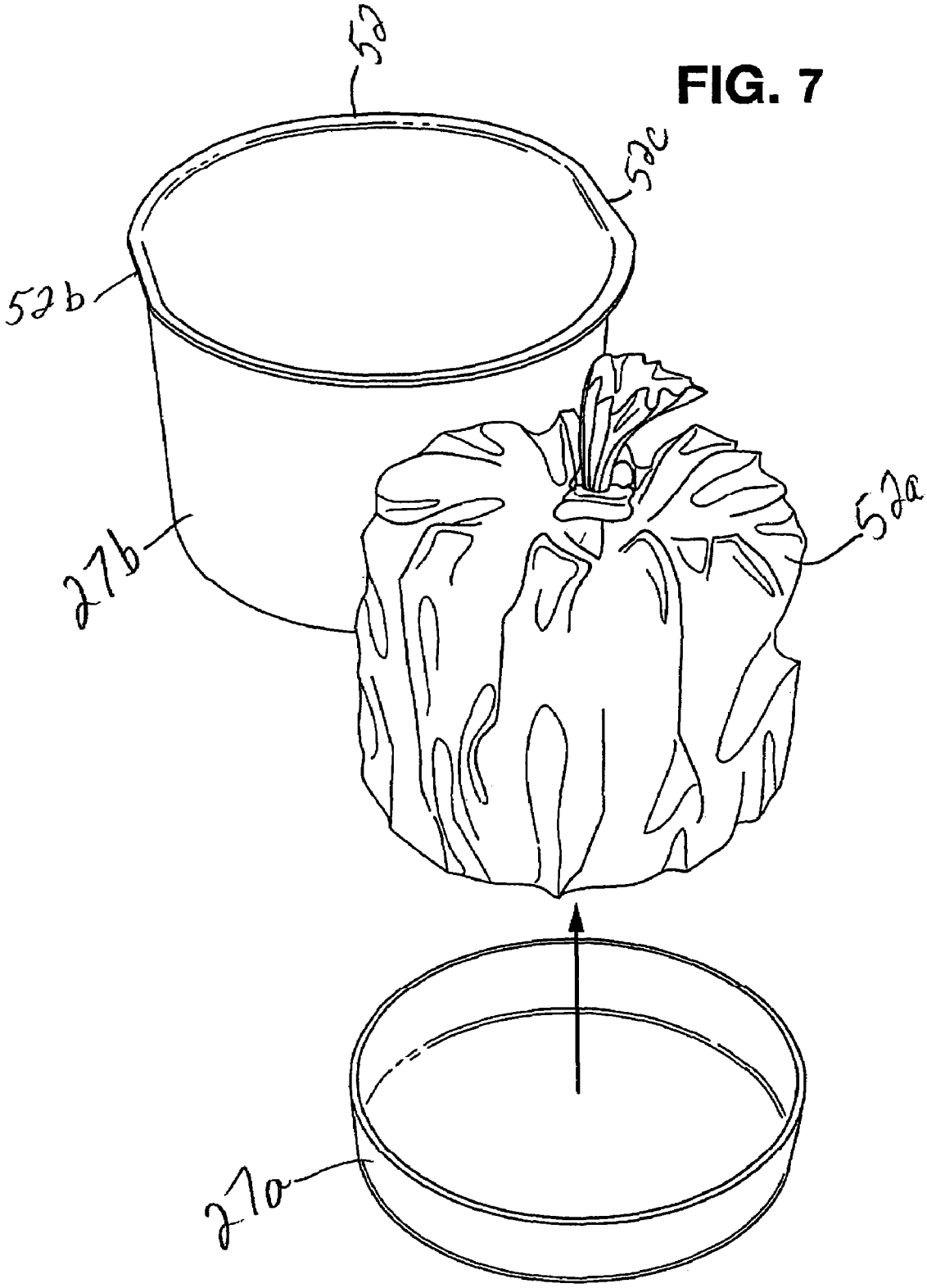
FIG. 7 is an elevated perspective view of components of the embodiment of FIG. 1.

As shown in FIGS. 2, 3 and 4 for example, in a presently preferred embodiment, a trash receptacle 27 can be disposed selectively in the lower portion 16 of the housing. The trash receptacle 27 can be in the form of a tub, a vat or a pail for example. As shown in FIGS. 2 and 3 for example, the trash receptacle 27 can include a bottom section 27*a* formed as a shallow pan that is configured to rest on the floor 16*a* of the trash can 12 and has a short vertically disposed sidewall. As shown in FIGS. 6 and 7, the trash receptacle 27 includes a cylindrical sidewall 27*b* that has a lower section that nests inside the bottom section 27*a* of the trash receptacle 27. An upper section of the cylindrical sidewall 27*b* forms the upper peripheral edge 52 of the trash receptacle 27 and defines an open top. As shown in FIGS. 6 and 7, a flexible plastic bag or liner 52*a* can be supported inside receptacle 27. Thus, the upper peripheral edge 52 of the trash receptacle 27 can define a receptacle opening that is disposed to receive trash contents that are deposited through the trash opening 20 in the top 17 of the housing 13. However, the trash receptacle 27 is not an essential component of every embodiment of the present invention.

In an alternative embodiment, the rigid tub or vat that defines the trash receptacle 27 shown in FIGS. 2 and 3 for example, can be replaced by a trash bag that is formed of plastic for example. The upper edge of the opening in the trash bag can be hung around the interior of the lower portion 16 of the housing 13. Once the trash is compacted in the trash bag, the upper edge of the trash bag can be unhung from within the housing 13 and gathered at the top to close the opening in the trash bag. The attendant then can remove the trash bag from the trash can 12 and cart the bag off to a central collection point for the trash.

As explained below, the trash that is collected in the trash receptacle 27 can be compressed within the trash receptacle 27, which then can be selectively removed together with the compacted trash from the lower portion 16 of the housing via the access opening 25. An empty trash receptacle 27 also can be selectively inserted into the lower portion 16 of the housing in the same manner, using the door 26 that is defined as part of the lower portion 16 of the housing 13. As shown in FIGS. 4 and 5, the peripheral edge 52 defines a pair of opposed straight edges 52*b* and 52*c* that are configured to conform edge 52 to the flat opposed surfaces of the portion of the frame that is disposed in the lower portion 16 of the housing.

Figure 8:
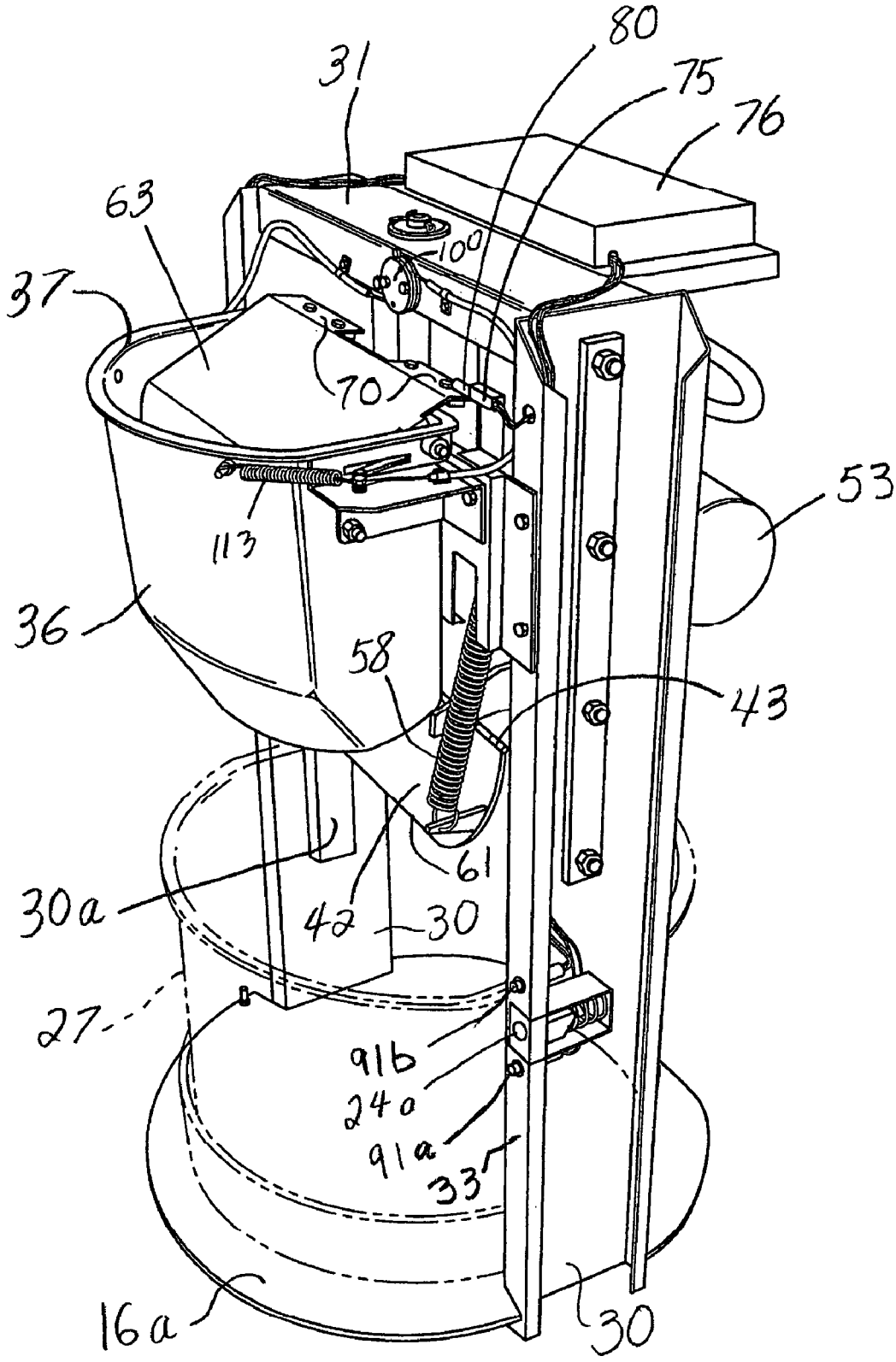
FIG. 8 is an elevated perspective view of components of the embodiment shown in FIG. 1 taken from one side with elements shown in phantom (chain-dashed line)
Figure 9:
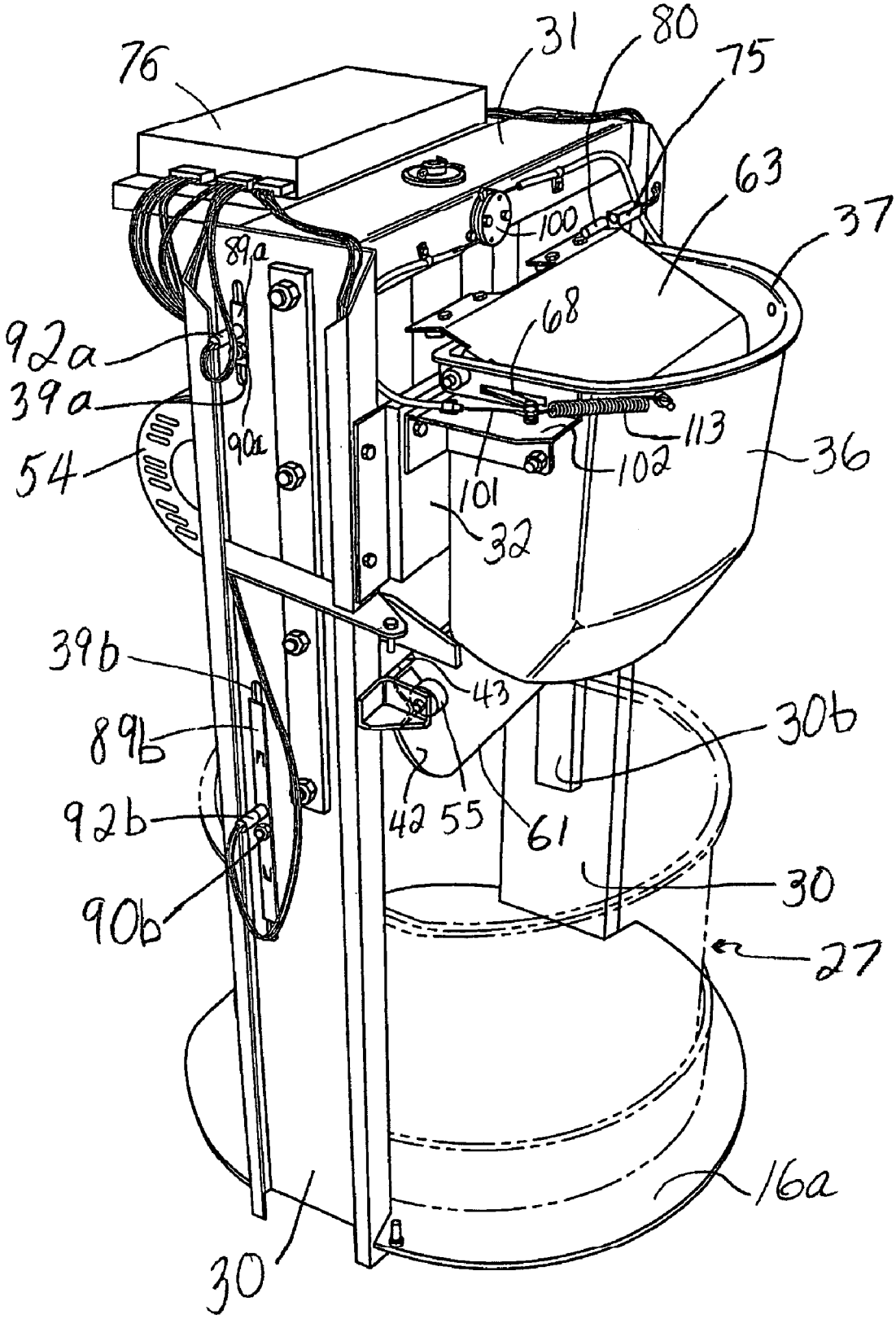
FIG. 9 is an elevated perspective view of components of the embodiment shown in FIG. 1 taken from the opposite side with elements shown in phantom (chain-dashed line)
Figure 10:
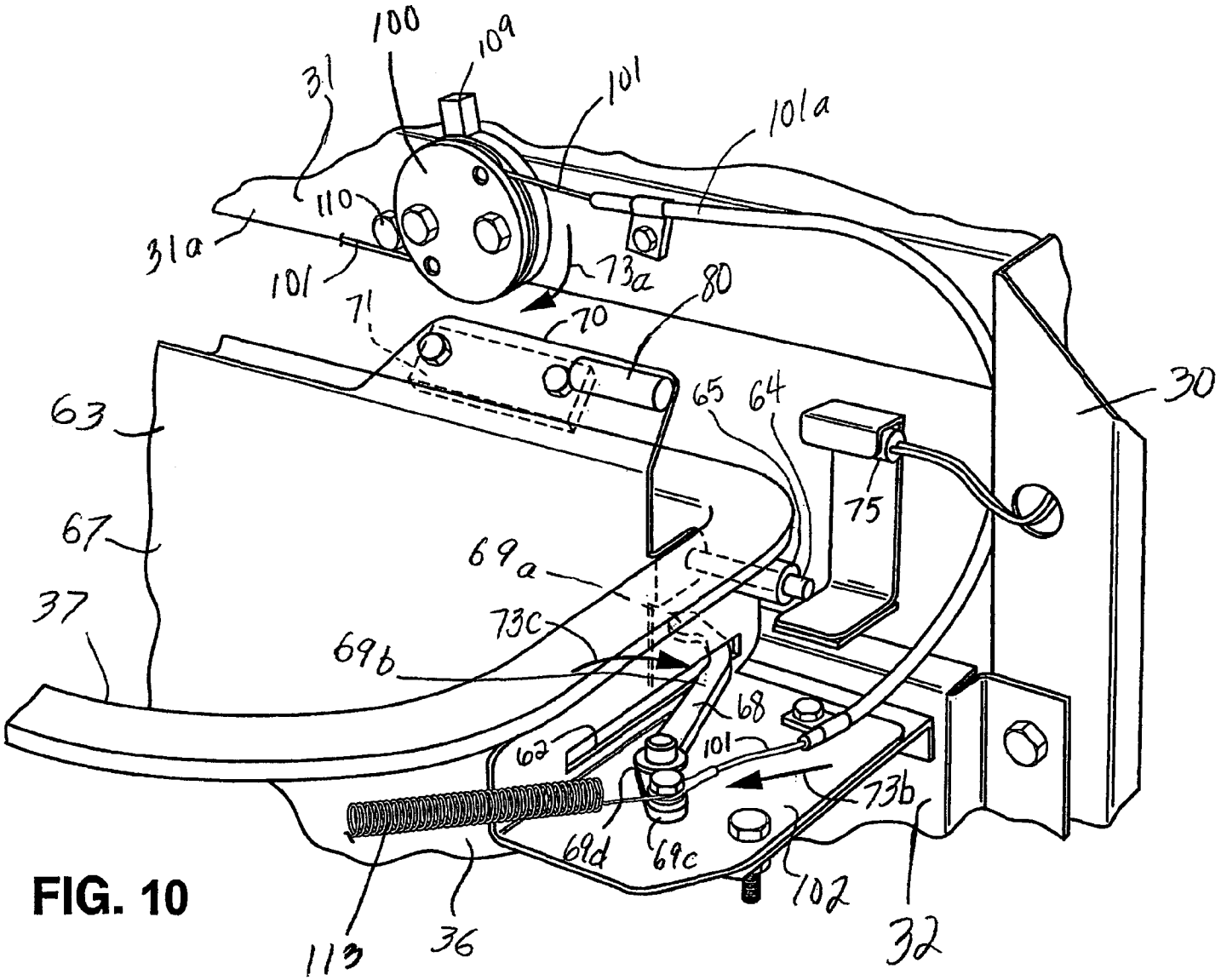
FIG. 10 is an elevated perspective view of components of a portion of the embodiment of FIG. 1 with some elements shown in phantom (dashed line)
Figure 11:
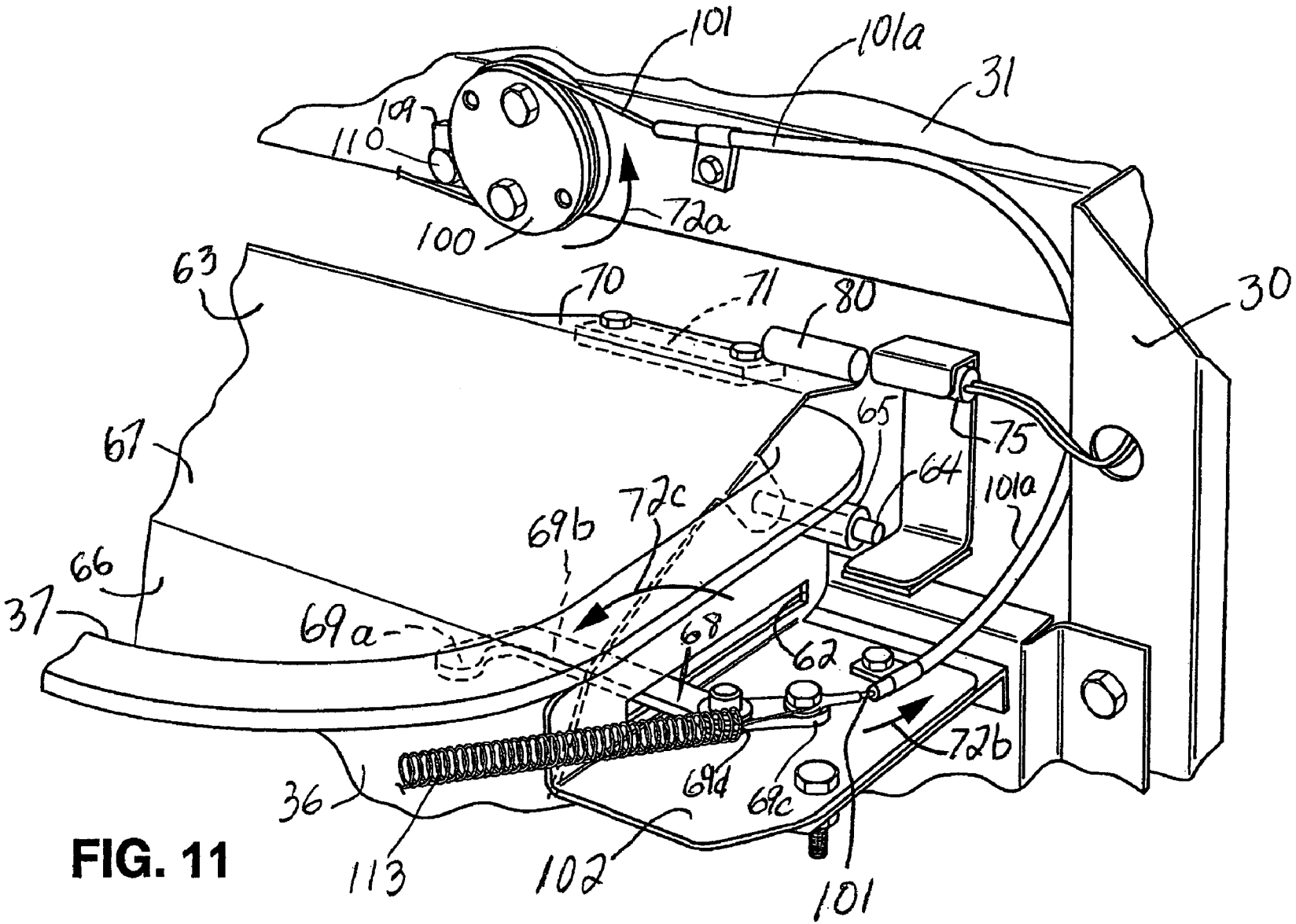
FIG. 11 is an elevated perspective view of components of a portion of the embodiment of FIG. 1 with some elements shown in phantom (dashed line)

The apparatus for receiving and compacting trash contents also includes a frame that is disposed within the housing. As shown in FIGS. 8 and 9 for example, the frame includes a plurality of rigid structural members that carry and/or provide support for other components of the trash can of the present invention. These components of the frame typically include a pair of spaced apart vertically extending side rails 30 and a top rail 31 having opposite ends. One end of the top rail 31 can be desirably connected to the top of each side rail 30. As shown in FIGS. 10 and 11 for example, the frame also can include a cross brace 32 that has opposite ends connected to the front of the side rails 30 at an intermediate location along their lengths and extends transversely between the side rails 30.

As embodied herein and shown in FIG. 8 for example, the frame can be formed as an integrated structure composed of a number of sub-components, which can be permanently attached to each other as by welding or riveting for example. Alternatively, some or all of the sub-components can be attached to one another in a way that renders them detachable, as by nuts and bolts for example. Moreover, the frame can be formed as two or more unattached sub-assemblies of sub-components so that none of the sub-assemblies is connected to any of the other sub-assemblies in the frame. The frame desirably is connected to the housing 13, but can remain detached in alternative embodiments.

In accordance with the present invention, a trash by-pass chute is disposed within the housing. As embodied herein and shown in FIGS. 2 and 3 for example, the by-pass chute 36 desirably has an entrance 37 that is aligned generally with the trash opening 20 in the top 17 of the housing 13. The by-pass chute 36 also has an exit 38 that is disposed generally in alignment with entrance 37 and disposed to empty into the intermediate portion 15 and lower portion 16 of the housing 13. As embodied herein and shown in FIGS. 2 and 3 for example, at least the entrance 37 of the by-pass chute 36 desirably has a transverse cross-sectional shape that conforms generally to the shape of the trash opening 20 defined in the top wall 19 of the housing 13. In the embodiment shown in FIGS. 8 and 9 for example, at least a portion of the trash by-pass chute 36 is carried by the frame 30, 32 within the housing 13 and is permanently attached to a portion of the frame, as by welding or bolting to the cross brace 32, which can be welded or bolted to side rails 30.

As shown in FIGS. 2 and 3 for example, the by-pass chute 36 is disposed generally in the upper portion 14 and intermediate portion 15 of the housing and provides a vertically aligned hollow structure. The entrance 37 of the by-pass chute 36 coincides generally with a second end of the funnel 23 (if the embodiment includes a funnel 23) that is opposite the funnel's first end, which is connected to the trash opening 20. The area of the exit 38 of the by-pass chute 36 is smaller than the area of the trash receptacle's open top that is defined by the upper peripheral edge 52 of the trash receptacle 27. Nonetheless, the exit 38 of the by-pass chute 36 empties directly above and is aligned with the open top of the trash receptacle 27. As will be explained below, components of the compacting mechanism must move into the lower portion 16 of the housing where the trash is to be compacted by the compacting mechanism. And this must be accomplished without components of the compacting mechanism becoming contaminated by trash that must travel from the top 17 of the housing 13 all the way down to the housing's lower portion 16 where the compacting will occur. The by-pass chute 36 functions to provide a directed conduit for the trash from the opening 20 in the top 17, through the upper portion 14 of the housing 13 and through at least part of the intermediate portion 15 of the housing. In this way, the by-pass chute 36 assists in shielding the compacting mechanism from contamination with trash.

In further accordance with the present invention, a compacting mechanism is provided. The compacting mechanism is desirably carried by the frame and includes a platen. The compacting mechanism includes an extendable member that is configured for moving the platen through a compaction stroke in order to apply compacting pressure to the trash contents that are disposed in the lower portion 16 of the housing. This compacting pressure is applied to the trash during at least a portion of the compaction stroke. In delivering the compaction stroke, at least some components of the compacting mechanism move from the intermediate portion 15 of the housing 13 into the lower portion 16 of the housing and then return through the intermediate portion 15 of the housing.

Figure 12:
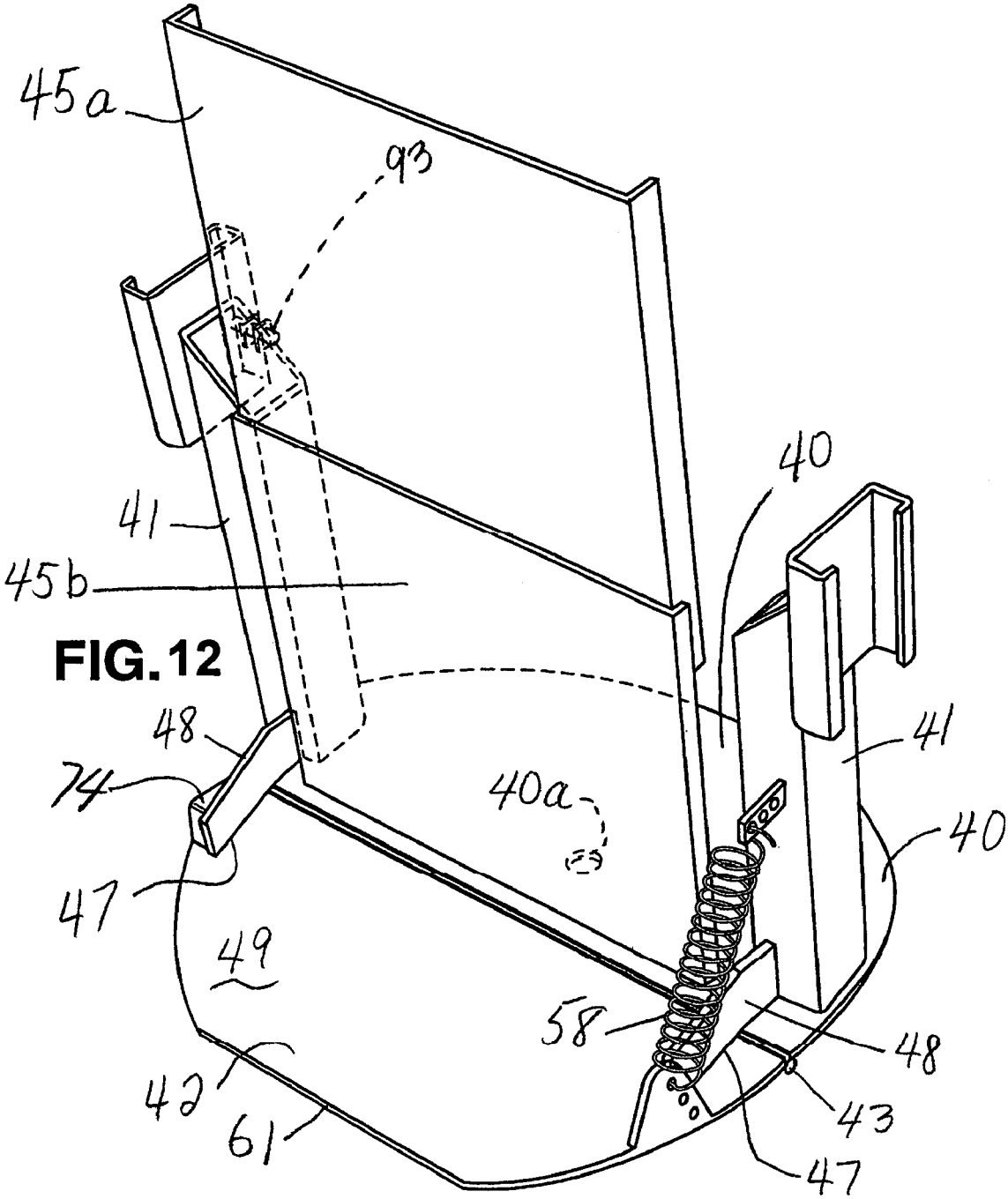
FIG. 12 is an elevated perspective view of components of a portion of the embodiment of FIG. 1 with some elements shown in phantom (dashed line)
Figure 13:
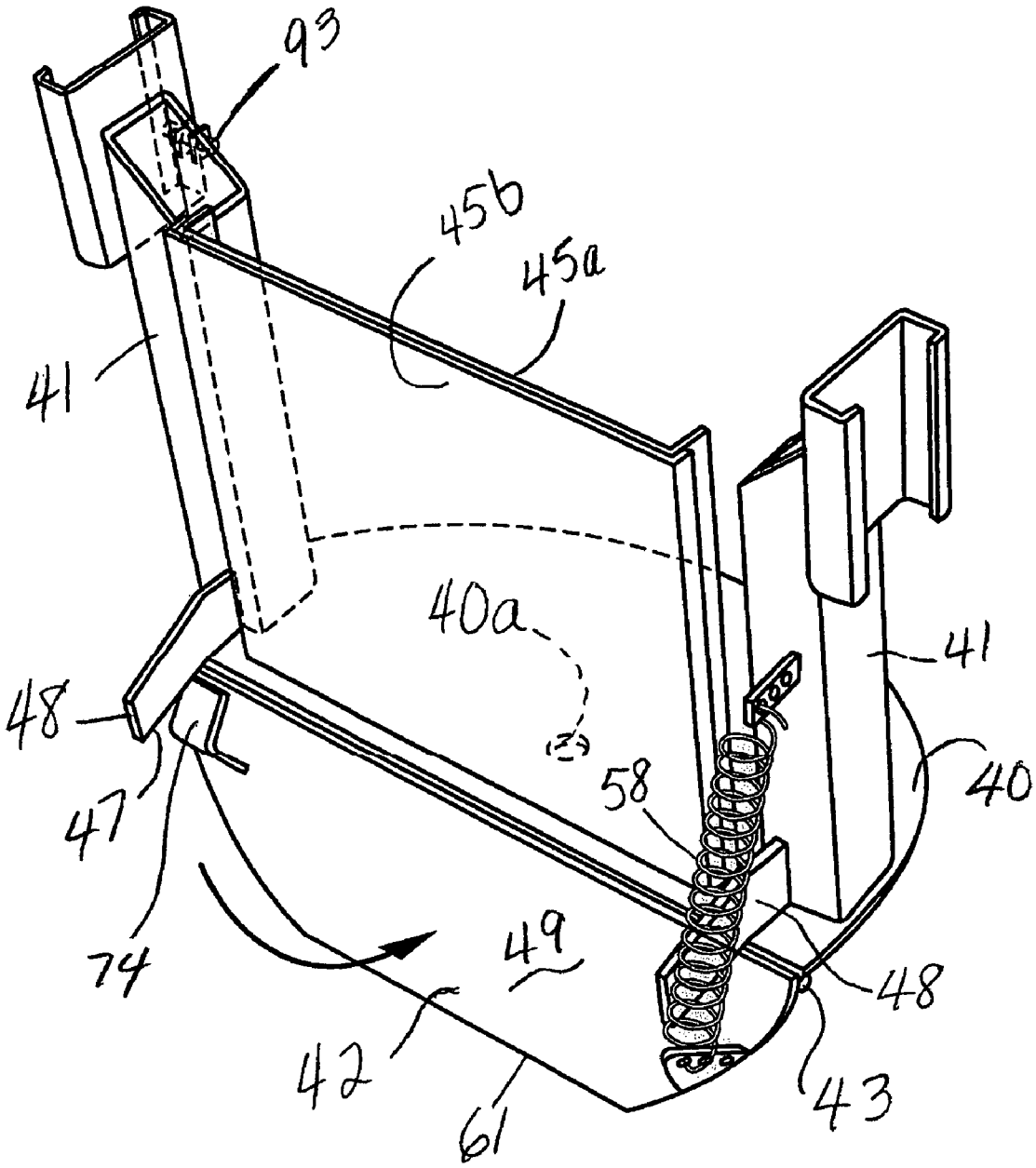
FIG. 13 is an elevated perspective view of components of a portion of the embodiment of FIG. 1 with some elements shown in phantom (dashed line)
Figure 14:
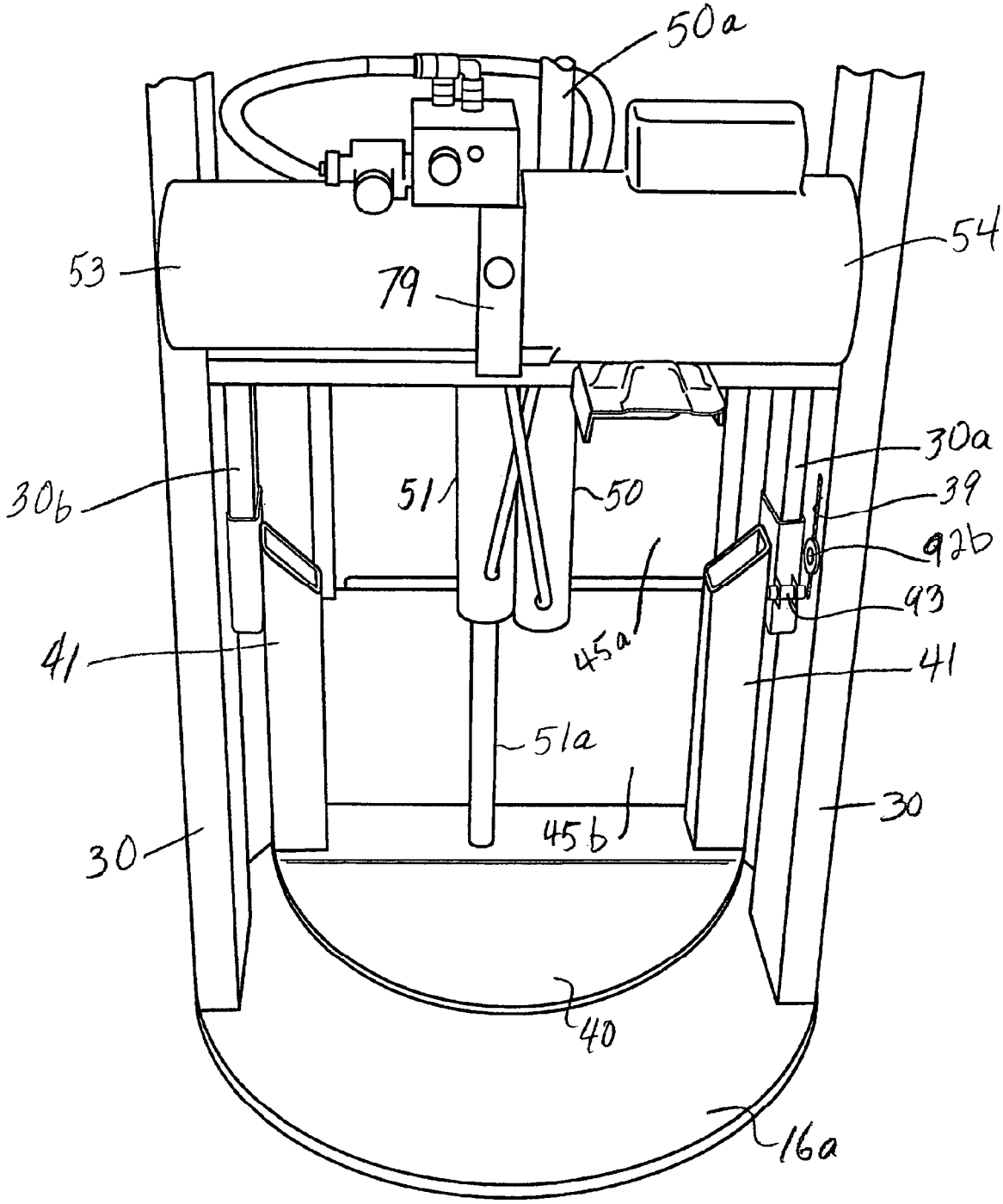
FIG. 14 is an elevated perspective rear view of components of a portion of the embodiment of FIG. 1.

As embodied herein and shown in FIGS. 2, 3, 12 and 13 for example, the compacting mechanism desirably includes a sturdy, rigid flat plate that forms a first portion 40 of the platen. As embodied herein and shown in FIGS. 12 and 13, the compacting mechanism also includes an extendable member, which can include a carriage that comprises a pair of opposed side bars 41. As shown in FIG. 2, the first portion 40 of the platen desirably is connected to and carried by the lower ends of the side bars 41 that form the compacting carriage. One of the opposed ends of each side bar 41 is rigidly connected to a first portion 40 of the platen as by welding. As shown in FIGS. 12 and 13, the upper portion of each side bar 41 is configured for slideably engaging one of the side rails 30 forming the frame. As shown in FIG. 14, each side bar 41 desirably engages and rides along one of the opposed tracks 30*a*, 30*b* formed in one of the side rails 30 of the frame.

As shown in FIGS. 2, 3, 8, 9, 12 and 13, the platen also defines a pivotable portion 42 that is pivotally connected to the first portion 40 of the platen. As shown in FIGS. 2 and 3 for example, one end of a hinge 43 such as a piano hinge can be connected to the underside 44 of the platen's pivotable portion 42. The opposite end of the hinge 43 can be connected to the underside 46 of the platen's first portion 40. As shown partially in phantom (chain-dashed line) in FIG. 12 for example, the leading edge of the first portion 40 and the pivotable portion 42 of the platen are shaped to conform roughly to the shape of the inside surface of the sidewall 18 of the housing 13 and thus are substantially circular for the embodiment shown. As shown in the side views of FIGS. 2 and 3 for example, the shape of platen when the pivotable portion 42 is fully laterally extended is slightly concave and thus tends to gather the compacted trash towards the center of the platen and away from the sidewall 27*b* of the trash receptacle 27 as the trash is being compacted. In order to attain this concave, gathering effect, the pivotable portion 42 of the platen defines a front section and an adjacent section that is contiguous with the front section. As shown in the side view of FIG. 2 for example, the free edge 61 of the pivotable portion 42 of the platen points away from the exit 38 of the trash bypass chute 36 so that the front section desirably resides in a plane that forms an obtuse angle with the plane of the adjacent section of the pivotable portion 42 of the platen.

As shown in FIG. 3 for example, the extendable member includes a telescoping wall 45 that includes an upper plate 45*a* slideably engaging a lower plate 45*b*. As shown in FIGS. 12 and 13 for example, each individual upper plate 45*a* and lower plate 45*b* is configured as a generally flat planar member having opposed side flanges that are disposed at a right angle to the plane of the planar member portion of each plate 45*a*, 45*b*. Desirably, one of the plates nests within the other plate. As shown in FIGS. 12 and 13 for example, upper plate 45*a* nests within lower plate 45*b* such that the side flanges of upper plate 45*a* fit within the confines of the expanse of the side flanges of lower plate 45*b*. The lower edge of lower plate 45*b* is rigidly connected to the first portion 40 of the platen. Though not visible in any of the views shown in the Figs., the upper edge of the upper plate 45*a* is rigidly connected to part of the frame such as cross brace 32. As schematically shown in FIGS. 2 and 3 for example, as the lower plate 45*b* of the telescoping wall 45 of the extendable member of the compacting mechanism moves downwardly, any liquids or small items of trash falling from the exit 38 of the by-pass chute 36 are prevented from fouling the extendable piston 51*a* that is connected to the first portion 40 of the platen and shielded from the trash by the telescoping wall 45. The shielding function of the telescoping wall 45 reduces the frequency of maintenance that otherwise might be needed to keep the extendable piston 51*a* from becoming fouled with sticky liquids and/or soil and trash that might adversely affect the operation of the piston as it is retracted into the hydraulic cylinder 51*b*.

The extendable member in the embodiment of the compacting mechanism shown in FIGS. 12 and 13 also includes a pair of spaced apart reinforcing plates 48 for the platen. As schematically shown in FIG. 12 for example, one of the longer narrow side edges 47 of each reinforcing plate 48 is disposed to rest against the upper surface 49 of the pivotable portion 42 of the platen when the platen is extended so as to compact the trash. Each reinforcing plate 48 is rigidly connected to the first portion 40 of the platen and to one of the side bars 41, as by welding or riveting for example. Other connection means can include detachable rigid connections such as can be effected using bolts and nuts for example. As schematically shown in FIGS. 12 and 13, a cam 74 is mounted on the upper surface 49 of the pivotable portion 42 of the platen near one edge that is close to the hinge 43.

A mechanism is provided for biasing the pivotal portion 42 of the platen in an orientation that is generally coplanar with the first portion 40 of the platen. The coplanar orientation is easily visible in FIG. 12. As embodied herein and shown in FIG. 12, the biasing mechanism is provided in the form of at least one resilient spring 58. One end of each spring 58 is connected to one end of the pivotable portion 42 of the platen as by connecting through a hole in a flange extending from the upper surface 49 of portion 42 near one edge thereof. The opposite end of spring 58 is connected to the nearby side bar 41 by connecting through a hole in a flange extending from the side bar 41. As shown in FIG. 12 for example, the tension in the spring 58 tends to pull the platen's pivotable portion 42 against the long narrow edges 47 of the reinforcing plates 48. So positioned, the platen's pivotable portion 42 is disposed in an orientation that is generally co-planar with the first portion 40 of the platen.

Figure 18:
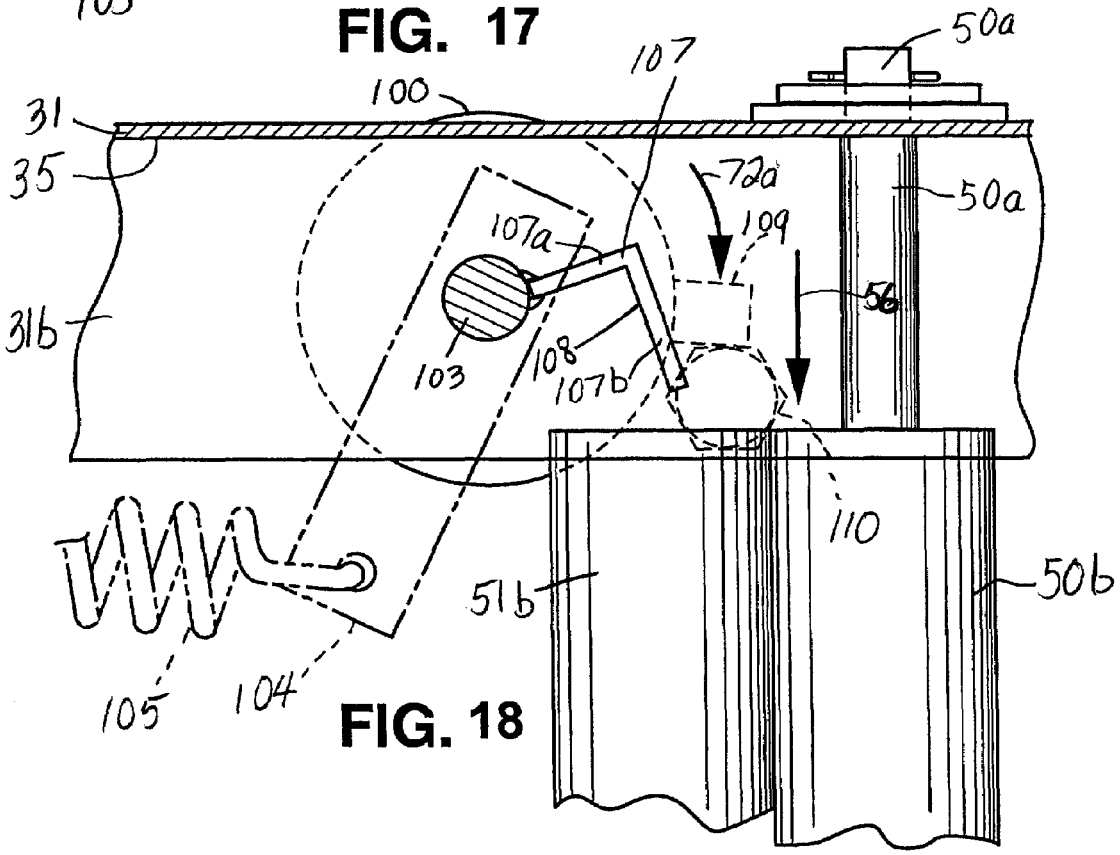
FIG. 18 is cross-sectional view of the embodiment of FIG. 1 taken along the lines of sight indicated by the arrows designated F, G in FIG. 16 with some features shown in phantom (dashed line)
Figure 19:
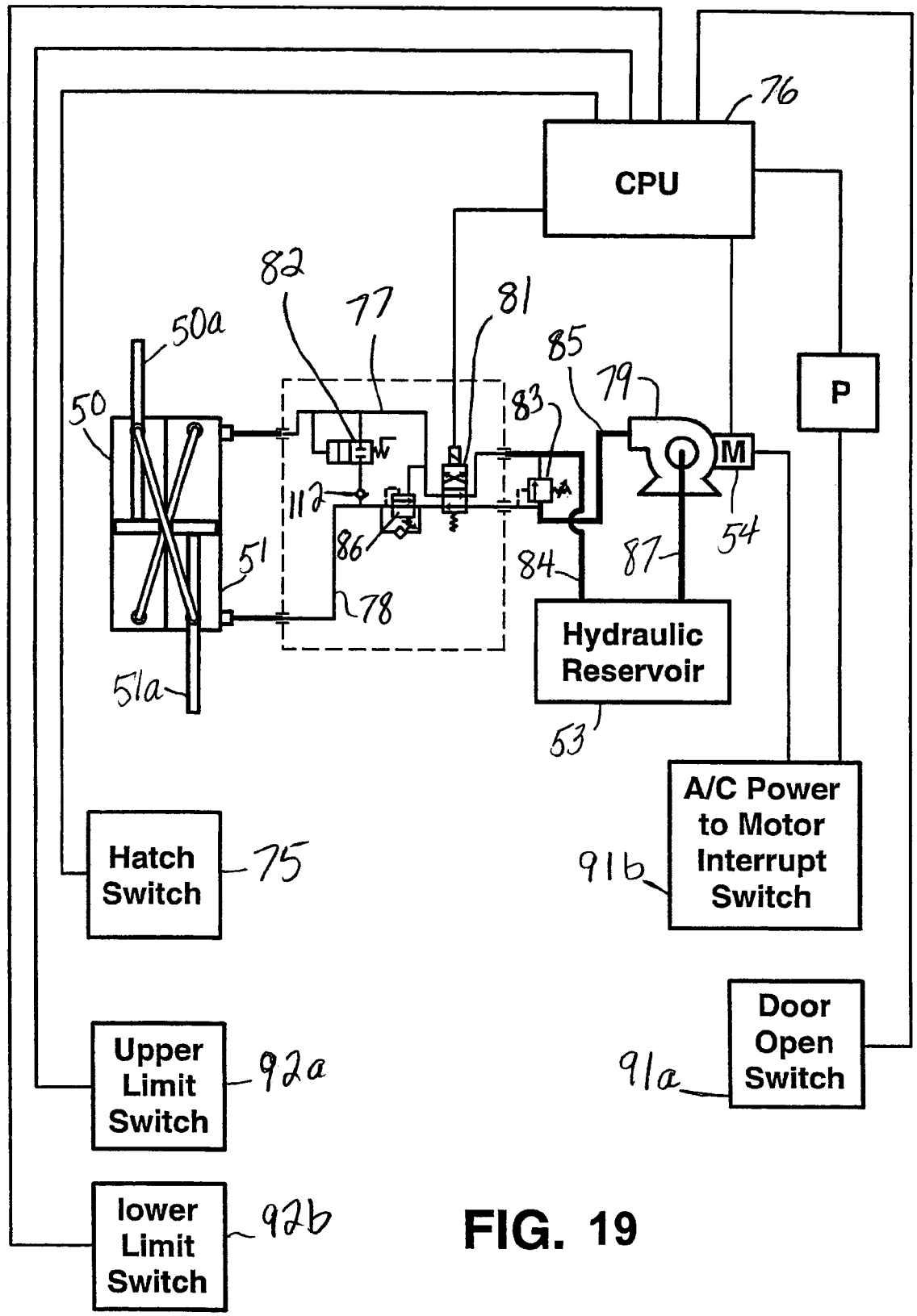
FIG. 19 is an elevated perspective view of components of the embodiment of FIG. 1.

As shown in FIGS. 14, 2 and 3 for example, the extendable member of the compacting mechanism also includes an interconnected pair of dual-acting hydraulic rams 50, 51. As shown schematically in FIG. 14, the hydraulic cylinder of each ram 50 or 51 is connected side-by-side to the hydraulic cylinder of the other ram 50 or 51. As shown schematically in FIG. 14 for example, the distal end of the piston 50*a* of one ram 50 forms one end of the extendable member that is rigidly connected to the top rail 31 (See FIG. 18) of the frame. As schematically shown in FIGS. 14 and 3, the distal end of the piston 51*a* of the second ram 51 is at the opposite end of the extendable member and is connected rigidly to the first portion 40 the platen. An opening 40*a* is shown in phantom in FIGS. 12 and 13 to enable the distal end of the piston 51*a* to be connected to the first portion 40 of the platen. As schematically shown in FIGS. 2 and 3, the piston connections desirably are generally centrally located between the side rails 30 of the frame. As schematically shown in FIGS. 14 and 19 for example, the rams 50, 51 desirably are hydraulically connected to operate together. Each ram 50, 51 is a dual-acting ram such that a hydraulic pump 79 can operate the piston to be extended from the ram or retracted into the ram. Thus, as schematically shown in FIG. 19 for example, the chambers of the cylinders 50*b*, 51*b* that cause the respective pistons 50*a*, 51*a* to retract into the cylinders 50*b*, 51*b* are hydraulically connected to each other. Similarly, the chambers of the cylinders that cause the respective pistons to extend out of the cylinders are hydraulically connected to each other. In this way, both pistons 50*a*, 51*a* extend simultaneously or retract simultaneously, thus allowing the compacting mechanism to operate at twice the speed of a single ram. However, other hydraulic circuits could be used to power the compacting mechanism.

As shown in FIG. 14 for example, the compacting mechanism further includes a reservoir 53 containing hydraulic fluid and an hydraulic pump 79 driven by an electric motor 54 for introducing the hydraulic fluid under pressure into each ram 50, 51 to extend each piston 50*a*, 51*a*, accordingly. As shown schematically in FIG. 14, appropriate control valving also forms part of the compacting mechanism, and the rams 50, 51, reservoir 53, and pump 79 desirably are carried by the frame.

Moreover, while the hydraulic mechanism that powers the compacting mechanism is presently the preferred embodiment, other types of power can be used to operate the required compacting mechanism. For example, an electrically operated motor-driven compacting mechanism also could be used. Another alternative embodiment could employ air-driven cylinders rather than hydraulically actuated cylinders.

As shown in FIGS. 8, 9 and 2, the platen is configured to by-pass the trash by-pass chute 36 when the compacting mechanism is oriented in the fully retracted position (indicated in phantom in FIG. 2 by the chain-dashed line). In this fully retracted position, the platen's pivotable portion 42 is folded away from the top 17 of the housing 13 and has its cam 74 disposed against the outer circumferential surface of a roller 55 that is rotatably mounted to a side rail 30 (FIG. 9) of the frame. As shown in FIG. 2 for example, in this fully retracted orientation of the compacting mechanism, trash that enters the trash opening 20 through the top 17 of the housing falls through the funnel 23 and through the by-pass chute 36 and into the open top of the trash receptacle 27.

The solid line rendition of the platen in FIG. 2 is moving in the direction of the arrow designated 56 and is about to begin compacting a load of trash 57 that is in the receptacle 27. In the illustrated embodiment, the spring 58 also provides a mechanism for biasing the pivotable portion 42 of the platen in an orientation that is capable of transmitting compacting pressure to the trash contents that are disposed in the lower portion 16 of the housing. This compacting pressure of course is only provided during a portion of the compaction stroke when the platen actually makes contact with the trash contents disposed in the lower portion 16 of the housing. In an embodiment that includes a receptacle 27 containing the trash contents 57 such as shown in FIG. 3 for example, the compacting pressure is applied to the trash contents disposed in the receptacle.

As the platen moves downwardly relative to the by-pass chute 36 in a manner illustrated successively in FIGS. 2 and 3, the biasing mechanism eventually pulls the pivotable portion 42 of the platen into the substantially coplanar orientation shown in solid line in FIGS. 2 and 3. In this generally co-planar orientation of the pivotable portion 42 of the platen, the compacting mechanism can move in the direction of the straight arrows designated 56 in FIGS. 2 and 3 begin the portion of the compaction stroke during which compacting pressure is applied by the platen to the trash contents that are disposed in the lower portion 16 of the housing. As shown in FIG. 3 for example, the platen of the compacting mechanism is oriented for a portion of the compaction stroke during which pressure is being applied to the trash contents disposed in the receptacle 27 located in the lower portion 16 of the housing 13.

The retraction stroke of the compacting mechanism is essentially a reverse of the compaction stroke of the compacting mechanism. Accordingly, during the retraction stroke the platen of the compacting mechanism moves in a direction that is opposite to the arrows designated 56 in FIGS. 2 and 3. In this way, the platen is repositioned away from the lower portion 16 of the housing 13 during at least the latter portion of the retraction stroke. During this latter portion of the retraction stroke shown in FIGS. 8 and 9 for example, the pivotable portion 42 of the platen pivots away from the top 17 of the housing 13, and the free edge 61 of the pivotable portion 42 of the platen points down toward the lower portion 16 of the housing 13. In this way the compacting mechanism is configured for moving the platen through the retraction stroke so as to reposition the platen away from the lower portion 16 of the housing 13 during at least a portion of this retraction stroke. As shown in FIGS. 2 and 9, this downward movement of the pivotable portion 42 against the tension in the spring 58 is powered by the upward movement of the extendable member of the compacting mechanism as the pivotable portion 42 engages the roller 55 that is rotatably mounted on one side rail 30. The folding of the pivotable portion 42 of the platen enables the by-pass chute 36 to extend farther toward the lower portion 16 of the housing, thereby providing greater control over the descent of the trash, without interference with the compacting movements of the platen.

In further accordance with the present invention, a hatch is configured and disposed to control physical access through the trash by-pass chute. The hatch is configured to selectively pivot between a closed orientation where the hatch substantially blocks access through the trash by-pass chute and an open orientation where the hatch substantially permits access through the trash by-pass chute. As embodied herein and shown in FIGS. 2, 3, 10 and 11 for example, a hatch 63 is disposed at the entrance 37 of the trash by-pass chute 36. The hatch 63 is configured to selectively pivot between at least a first orientation (FIG. 11) wherein the hatch 63 substantially blocks access through the trash by-pass chute 36 and at least a second orientation (FIG. 10) wherein the trash contents are substantially permitted to pass through the trash by-pass chute 36. As shown in FIGS. 10 and 11 for example, a rotatable bar 64 is connected to the hatch 63. The bar 64 does not rotate relative to the hatch 63, but is rotatably received in opposed trunnion flanges 65 that are carried near the entrance 37 at the upper edge of the by-pass chute 36 as shown in FIGS. 10 and 11 for example.

As embodied herein and shown in FIGS. 8 and 11 for example, the hatch 63 is disposed in the first orientation in which the hatch 63 substantially blocks the entrance 37 of the trash by-pass chute 36. This first orientation of the hatch 63 is also shown in solid line in FIGS. 2 and 3 for example. This first orientation of the hatch 63 envisions any one of several positions, including a position just above the entrance 37 or a position even with the entrance 37 as well as a position just below the entrance 37 and actually inside the trash by-pass chute 36 as shown in FIGS. 2 and 3, this latter position being the presently preferred arrangement.

The second orientation of the hatch 63 is illustrated in solid line in FIG. 10 and in chain-dashed line in FIGS. 2 and 3 for example. An intermediate orientation of hatch 63 is also shown in chain-dashed line in FIGS. 2 and 3. In the second orientation, the hatch 63 is momentarily disposed near the inside surface of the rear wall of the by-pass chute 36 as the weight of the trash imparts angular momentum to the hatch 63 to rotate in that direction. In this second orientation, the hatch 63 essentially opens the access to the trash by-pass chute 36.

The hatch 63 can define a solid rigid member such as shown in FIGS. 2, 3, 10 and 11 for example. Alternatively, the hatch 63 can define a plurality of openings (not shown) that allow fluids to pass through the openings and into the trash by-pass chute 36. Other configurations of the hatch 63 also are possible and include a fine mesh screening that is stretched between the peripheral border that defines the outer periphery of the hatch 63.

Figure 15:
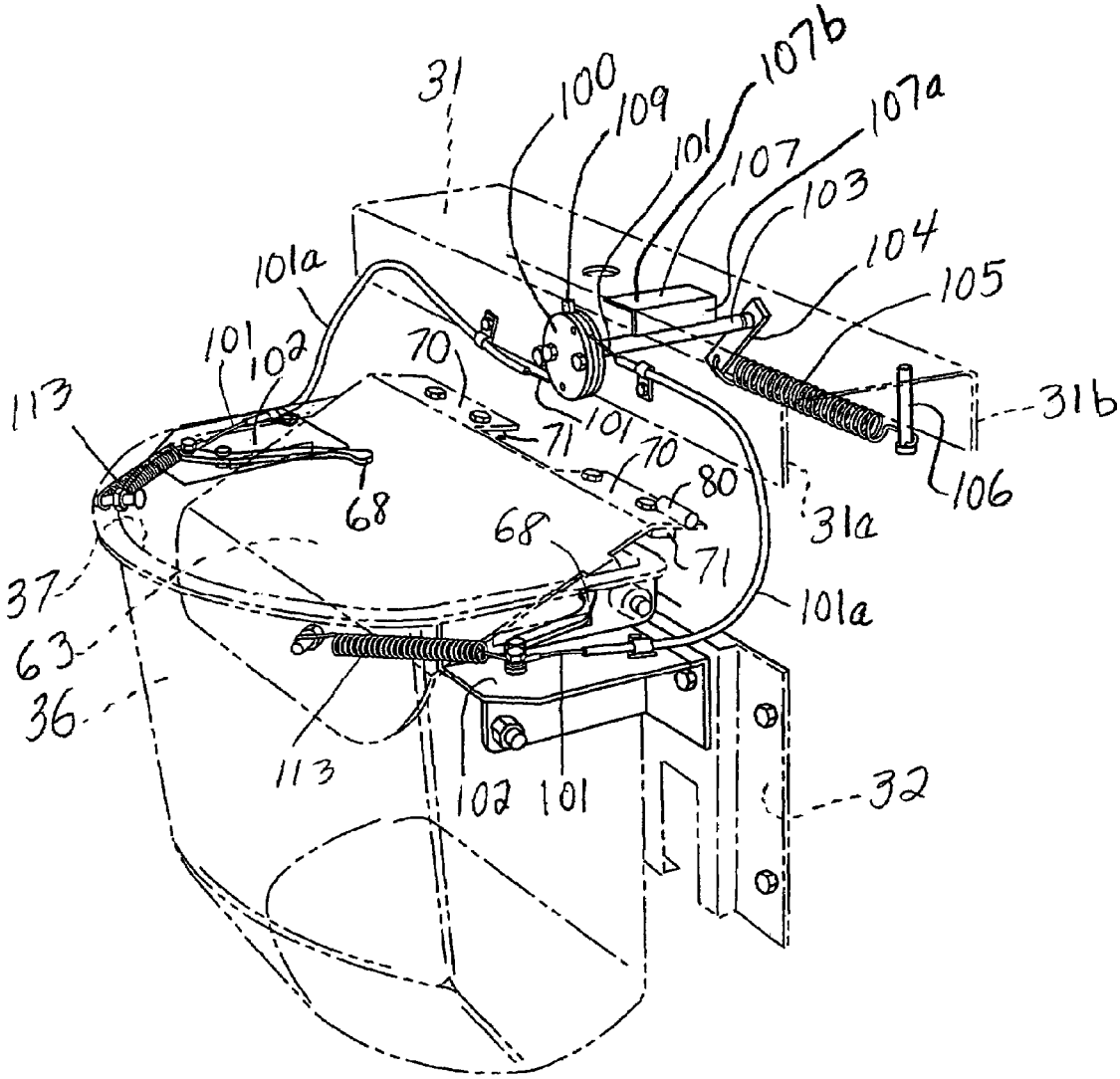
FIG. 15 is an elevated perspective view of components of the actuator mechanism of the embodiment of FIG. 1 with some elements shown in phantom (chain-dashed line)

As shown in FIGS. 10, 11 and 15, a counterflange 70 is connected to each rear edge of the hatch 63, and at least one counterweight 71 is pivotally connected to the underside of each counterflange 70. The weight of each counterweight 71 can be varied to change the moment of inertia of the combined counterflange 70 and counterweights 71 about the rotatable bar 64. Each counterweight 71 desirably weighs about 0.8 pounds.

The function of the counterflange 70 is to counterbalance the weight of the hatch 63. The desired equilibrium between the hatch 63 and the counterflange 70 and counterweight 71 holds the hatch 63 in the first orientation shown in FIGS. 1, 8, 9, 11 and 15 for example. The hatch 63 remains in this equilibrium first orientation until the weight of trash resting on the hatch 63 tips the balance so that the hatch 63 pivots downwardly into the by-pass chute 36 and towards the rear wall of the chute 36. With the hatch 63 so oriented open as shown in solid line in FIG. 10 and dashed line in FIGS. 2 and 3 for example, the trash can fall through the by-pass chute 36 and out of the exit 38 thereof and into the trash receptacle 27 in the lower portion 16 of the housing.

The hatch is desirably configured to define a front section and an adjacent section that is contiguous with the front section. As embodied herein and schematically illustrated in FIGS. 2 and 3, a front section 66 of the hatch 63 resides in a plane that forms and obtuse angle between the front section 66 and the adjacent section 67. As shown in FIGS. 2 and 3, the front section 66 defines a free edge that points toward the exit 38 of the trash by-pass chute 36 even when the hatch 63 is oriented in the closed position wherein the hatch 63 substantially blocks the access to the trash by-pass chute 36.

The purpose of the orientation of the front section 66 relative to the adjacent section 67 of the hatch 63 is to permit small items of trash and liquids to slide through the narrow gap that exists between the forward wall of the trash by-pass chute 36 and the free edge of the front section 66 of the hatch 63 when the hatch is in the closed orientation shown in solid line in FIGS. 2 and 3 for example. These small trash items then can pass into the trash by-pass chute 36 without causing the hatch 63 to rotate into the trash by-pass chute 36. As will be explained below, each rotation of the hatch 63 is monitored until a predetermined number of such rotations has occurred, whereupon a control unit will activate the compaction cycle of the compacting mechanism. To conserve energy, it is desirable that smaller bits of trash can be deposited without adding to the total number of instances of rotation of the hatch 63 that are monitored to determine when the next trash compaction cycle should occur.

As shown in FIG. 15 and partially in phantom in FIGS. 10 and 11 for example, at least one hatch stop 68 is disposed at the entrance 37 of the trash by-pass chute 36. The hatch stop 68 is a rigid member that is configured and disposed to selectively engage the hatch 63 so as to hold the hatch 63 at the first orientation wherein most trash is substantially blocked from access through the trash by-pass chute 36. In this substantially closed first orientation shown in FIG. 11, all but liquids and the smallest items of trash that pass through the trash opening 20 will be held on the upper surface of the hatch 63. As shown in FIG. 11 for example, when the hatch stop 68 is actuated to assume the closed orientation, its forward lobe 69*a* and part of its arm 69*b* extends through an elongated horizontally disposed, rectangular slot 62 into the interior space of the by-pass chute 36 near the entrance 37 thereof. So oriented, the hatch stop 68 prevents downward movement of the hatch 63, which is also indicated in a phantom view by the chain-dashed line in FIG. 15. The hatch stop 68 also can be selectively configured to retract from within the interior space of the by-pass chute 36 through the slot 62 in the side of the trash by-pass chute 36 in order to permit the hatch 63 to attain the second orientation shown in FIG. 10, which is the open orientation.

In accordance with the present invention, an actuator mechanism is connected to the hatch stop and configured to selectively actuate the hatch stop so that the hatch stop holds the hatch in the closed orientation or allows the hatch to assume the open orientation with respect to the trash by-pass chute. Desirably, the actuator mechanism is configured with a default status that causes the hatch stop to hold the hatch in the closed orientation whenever the compacting mechanism is moving the platen through a compaction stroke or a retraction stroke.

As embodied herein and shown schematically in FIGS. 10, 11, 15 and 16, the actuator mechanism includes a cable spool 100 and a flexible cable 101 connected between each hatch stop 68 and the spool 100. As shown in FIG. 15, a separate cable 101 is provided for each of two hatch stops 68, and one end of each cable 101 is connected to one end of each respective hatch stop 68. As shown in FIG. 10 for example, one end of cable 101 is pivotally connected to a rear lobe 69*c* of hatch stop 68 as by a mechanical fastener. A suitable fastener is provided by a bolt having a threaded free end that can be screwed into a threaded nut. Each cable 101 is formed of materials such as braided strands of metal wire and thus does not lengthen or shorten along its longitudinal axis, but does bend in directions transverse to the longitudinal axis. Each cable 101 is threaded through a hollow sheath 101*a*.

Figure 16:
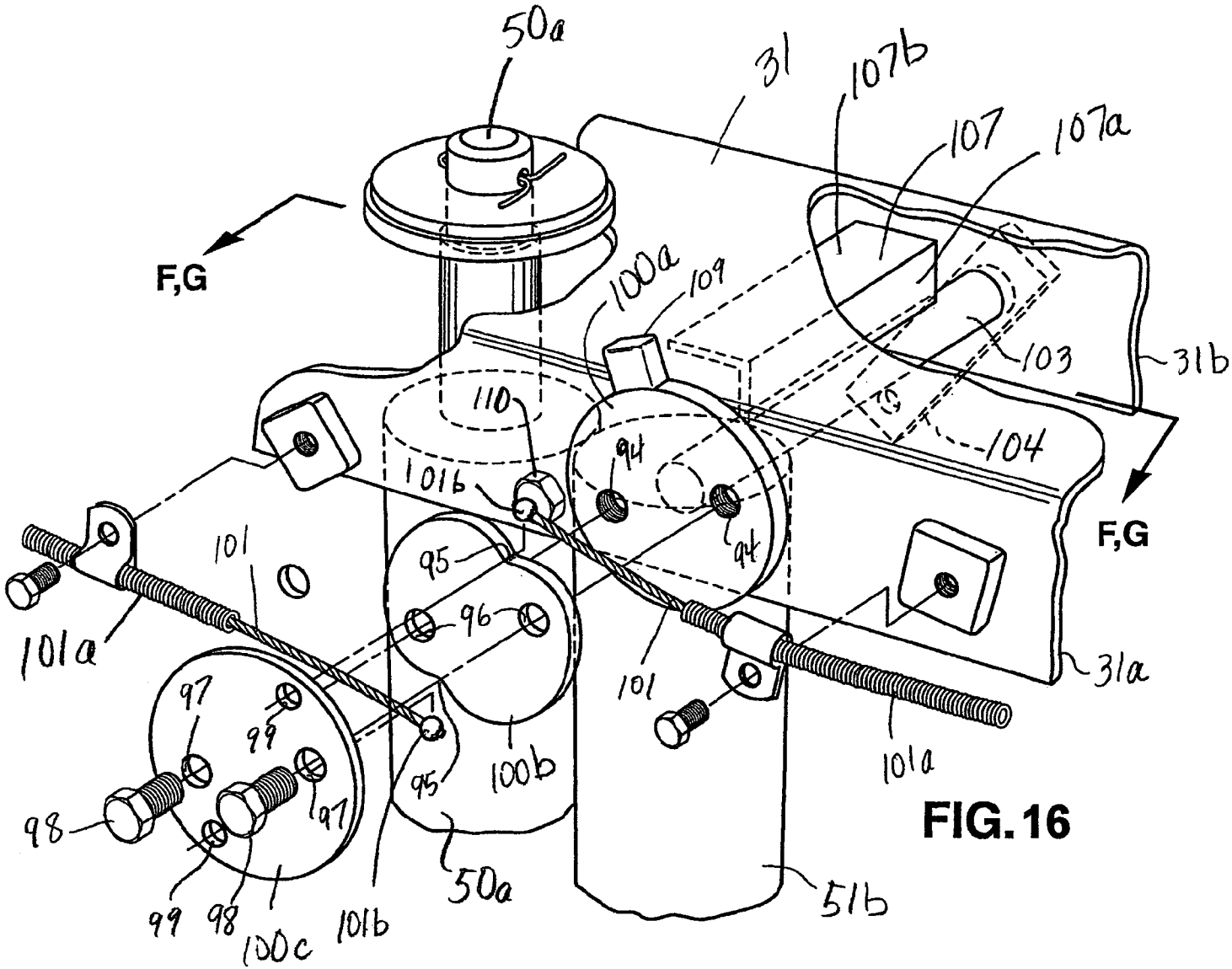
FIG. 16 is an elevated assembly view of components and portions thereof with some solid surfaces cut away and some shown in phantom (dashed line) of the embodiment of FIG. 1.

As shown in FIG. 16 for example, each hollow sheath 101*a* desirably is formed of a tightly coiled wire, and thus forms a conduit that, while flexible enough to bend transversely to its longitudinal axis, is rigid enough around its circumference to ensure that the cable 101 conforms to the shape of the sheath 101*a*. As shown in FIGS. 10 and 11, one end of the sheath 101*a* is rigidly connected to an actuator platform 102 that is disposed near each respective slot 62 that is formed through the side of the by-pass chute 36. Platform 102 can be connected to the cross-brace 32 of the frame. The opposite end of each sheath 101*a* is rigidly connected to the top rail 31 near where spool 100 is rotatably mounted. Each hatch stop 68 is pivotally connected to the platform 102 at the pivot point 69*d* that is disposed between one end of the arm 69*b* and the rear lobe 69*c*. As shown in FIGS. 10, 11 and 15 for example, one end of a coiled biasing spring 113 is connected to the rear lobe 69*c* of hatch stop 68 where the rear lobe 69*c* is connected to one end of the cable 101. As shown in FIGS. 8 and 9, the opposite end of the coiled biasing spring 113 can be anchored to the exterior of the front of the by-pass chute 36 near the entrance 37 thereof.

As schematically shown in FIG. 16 for example, the spool 100 desirably is formed as a flat disk with a generally circular circumferential edge and includes three separate components, namely, a spacer plate 100*b* that is sandwiched between a base plate 100*a* and a cover plate 100*c*. The base plate 100*a* is provided with a pair of threaded holes 94 that extend completely through the thickness of base plate 100*a*. The spacer plate 100*b* has a thickness that is smaller than the diameter of each spherically-shaped ball end 101*b* that is fixed to one end of each cable 101. The diameter of the outer circumference of spacer plate 100*b* is smaller than the diameter of each of the base plate 100*a* and cover plate 100*c*. The shape of the outer circumferential edge of spacer plate 100*b* defines a pair of opposed indentations 95. Spacer plate 100*b* further defines a pair of opposed holes 96 that are configured to align with the threaded holes 94 in base plate 100*a*. Cover plate 100*c* defines a pair of holes 97 that are configured to align with holes 96 in spacer plate 100*b* and threaded holes 94 in base plate 100*a*. Each of a pair of threaded bolts 98 is configured to pass through one set of aligned holes 97 and 96 to screw into an aligned threaded hole 94 of base plate 100*a* to connect the respective plates that combine to form spool 100.

Cover plate 100*c* also defines a pair of opposed retaining holes 99. Each retaining hole 99 is sized to be slightly smaller in diameter than the diameter of the ball end 101*b* that is located at one end of each cable 101. Moreover, each retaining hole 99 is disposed so that it is aligned with one of the indentations 95 in the circumference of spacer plate 100*b* when the bolts 98 are inserted through the respective holes 97, 96, 94 to assemble the spool 100. Before assembly of the spool 100, one of the ball ends 101*b* of one cable 101 is disposed against one of the indentations 95 of the spacer plate 100*b*, and similarly, the other ball end 101*b* is disposed in the other indentation 95. The cover plate is then placed over the spacer plate 100*b* so that each ball end 101*b* of a cable 101 projects through one of the retaining holes 99 in the cover plate 100*c*, and then the bolts 98 are threaded through the successive holes 97, 96 and screwed into holes 94 of the base plate 100*a* to complete assembly of the spool 100.

As schematically shown in FIG. 16 for example, a cylindrical rod 103 has one end (shown in phantom) rigidly connected to the back surface of the base plate 100*a* at the rotational center of the base plate 100*a*. Thus, rotation of the spool 100 also rotates rod 103 about its longitudinal axis. Rod 103 passes through a circular opening (not shown) through the front depending flange 31*a* (shown in phantom (chain-dashed line) in FIG. 16) of the top rail 31. As schematically shown in FIGS. 15 and 16, the opposite end of rod 103 is rotatably mounted in the rear depending flange 31*b* of top rail 31. As schematically shown in FIGS. 15 and 16 for example, this opposite end of rod 103 also is rigidly connected to a one end of a return arm 104, which has an opposite end connected to one end of a tension spring 105.

Figure 17:
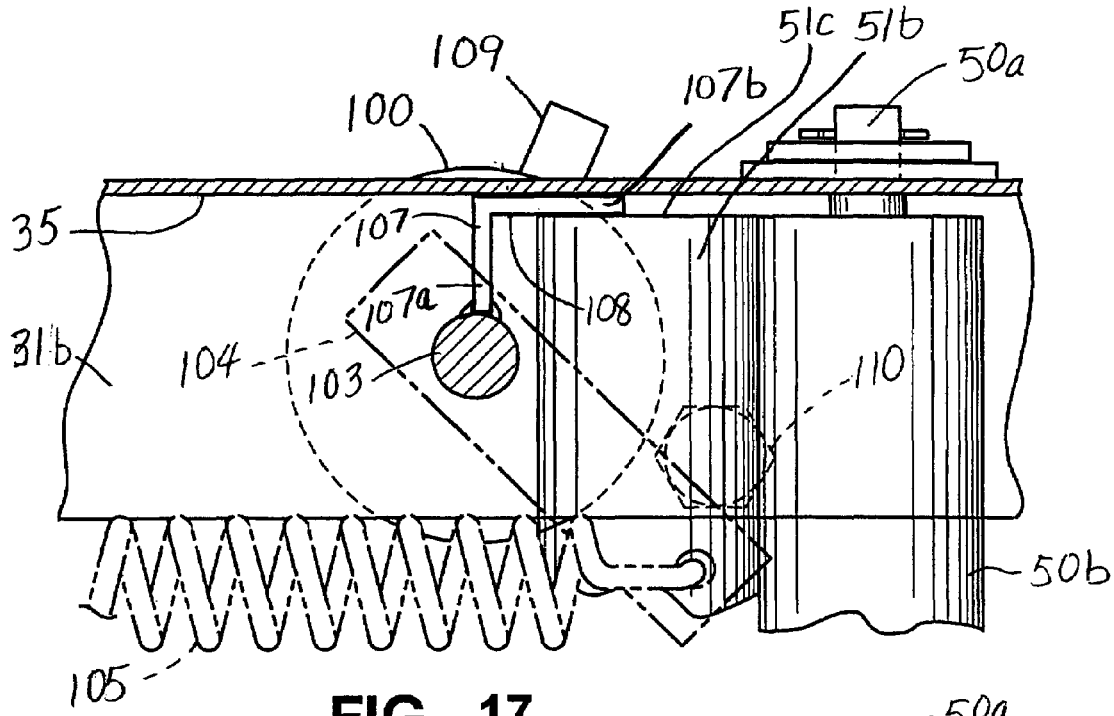
FIG. 17 is cross-sectional view of the embodiment of FIG. 1 taken along the lines of sight indicated by the arrows designated F, G in FIG. 16 with some features shown in phantom (dashed line)

As shown schematically in dashed line in FIGS. 15 and 16, the return arm 104 is mounted to the end of rod 103 that projects beyond rear depending flange 31*b* of top rail 31 so that the return arm 104 is disposed outside of top rail 31. The opposite end of tension spring 105 is connected to a post 106 that is rigidly connected to the outside of the rear depending flange 31*b* of top rail 31 and depends downwardly therefrom. As shown in FIGS. 15 and 16, an L-shaped cam follower 107 is formed by a pair of straight legs 107*a*, 107*b* that are joined at a right angle. As shown in FIGS. 16, 17 and 18, the unjoined edge of one of the legs 107*a* is rigidly connected to extend radially from the cylindrical rod 103. As shown schematically in FIGS. 15 and 17 for example, the attached leg 107*a* is sized so that the unattached leg 107*b* of cam follower 107 can rest essentially flush against the underside of top rail 31 when the attached leg 107*a* of cam follower 107 is disposed vertically.

FIGS. 10, 15 and 17 schematically illustrate the condition of the actuator mechanism that permits the hatch 63 to move freely into the by-pass chute 36 as shown in FIG. 10. As shown in FIG. 17, the outer surface of the unattached leg 107*b* of the cam follower 107 rests against the inner surface 35 of the top rail 31 during this condition of the actuator mechanism. Additionally, the base 51*c* of hydraulic cylinder 51*b* rests against the interior surface 108 of the unattached leg 107*b* of cam follower 107. In this state, the respective pistons 50*a* and 51*a* are completely retracted within the respective hydraulic cylinders 50*b*, 51*b*. The compacting mechanism is configured as shown in FIGS. 8 and 9. In this completely retracted state, the base 51*c* of hydraulic cylinder 5*b* pins the cam follower 107 against the underside 35 of the top rail 31 as shown in FIG. 17.

As the compacting mechanism begins a compaction stroke as shown in FIG. 2 for example, the pistons 50*a*, 51*a* begin to extend from their respective hydraulic cylinders 50*b*, 51*b*. This movement of hydraulic cylinders 50*b*, 51*b* is schematically indicated in FIG. 18 by the arrow 56. The force for the actuator mechanism is provided by the tension spring 105, which pulls on the return arm 104 as the respective pistons 50*a*, 51*a* extend out of the cylinders 50*b*, 51 *b* as shown in FIG. 18. The force exerted by the tension spring 105 is more than sufficient to overcome the forces exerted by both of the biasing springs 113 shown in FIG. 15 for example. This extension of the pistons 50*a*, 51*a* shown in FIGS. 2 and 3 for example causes the hydraulic cylinders 50*b*, 51 *b* to move away from the top rail 31. In so doing, the base 51*c* of hydraulic cylinder 51*b* releases the unattached leg 107*b* of cam follower 107 from being pinned against the top rail 31. The tension spring 105 causes cam follower 107 to rotate away from the top rail 31 in the direction of arrow 72*a* in FIG. 18. Rotation of the cam follower 107 away from the top rail 31 effects rotation of rod 103 in the direction of arrow 72*a* in FIG. 18. Rod 103 is rigidly connected to spool 100 via base plate 100*a* and so rotates spool 100 commensurately in the direction of arrow 72*a* in FIG. 11, which winds cable 101 onto spool 100. Referring to FIG. 11, as the spool 100 is rotated in the direction of the arrow designated 72*a*, the cable 101 moves in the direction of arrow 72*b* and pulls rear lobe 69*c* of hatch stop 68 and stretches the biasing spring 113. This tugging of the cable 101 on the rear lobe 69*c* causes the forward lobe 69*a* and arm 69*b* of the hatch stop 68 to pivot in the direction of arrow 72*c* through slot 62 and into the interior of the by-pass chute 36 until the hatch 63 is retained in the closed orientation.

The force for the release movement of the actuator mechanism is provided by the reverse movement of the hydraulic cylinders 50*b* and 51*b*. The rams 50, 51 retract their respective pistons 50*a*, 51*a* into the respective cylinders 50*b*, 51 *b* until they attain the state that is shown in FIG. 17. This retraction causes the hydraulic cylinders 50*b* and 51*b* to move toward the top rail 31. In so doing, the base 51*c* of hydraulic cylinder 51*b* engages the unattached leg 107*b* of cam follower 107 and pushes it toward the top rail 31. Movement of the cam follower 107 toward the top rail 31 effects rotation of rod 103 and the commensurate rotation of spool 100, which is rigidly connected to one end of rod 103 via base plate 100*a*. In this way, the spool 100 is rotated in the direction of; arrow 73*a* in FIG. 10. Referring to FIG. 10, as the spool 100 is rotated in the direction of arrow 73*a*, the cable 101 is being unwound from spool 100 and the tension in the biasing spring 113 is relaxed as the cable 101 moves in the direction of arrow 73*b*. This movement of the flexible cable 101 allows the biasing spring 113 to pull the rear lobe 69*c* of hatch stop 68 and thereby cause the forward lobe 69*a* and arm 69*b* of the hatch stop 68 to pivot in the direction of arrow 73*c*. Such movement withdraws the forward lobe 69*a* and arm 69*b* of the hatch stop 68 through slot 62 and removes them from the interior of the by-pass chute 36 until the hatch 63 is freed to move into the fully open orientation of the by-pass chute 36 shown in FIG. 10.

As shown in FIG. 16, a limit tab 109 projects radially from the circumferential edge of base plate 100*a*. A boss 110 projects from the exterior of the front depending flange 31*a* of top rail 31 as shown in solid line in FIG. 11 and in phantom (dashed line) in FIG. 18. As shown in FIG. 18, contact between the limit tab 109 and boss 110 limits the rotational travel of cam follower 107 and spool 100 in the direction of arrow 72*a* in FIG. 11. In this closed limit condition shown schematically in FIG. 18, the hatch stops 68 are fully extended into the by-pass chute 36 so that hatch 63 is held in the substantially closed orientation that is illustrated in FIG. 11 for example.

As shown in FIG. 17, contact between the unattached leg 107*b* of cam follower 107 and the underside surface of top rail 31 limits the rotational travel of cam follower 107 and spool 100 in the direction of arrow 73*a* in FIG. 10. Thus, the travel of return arm 104 is prevented from moving past the point of the open condition of the actuator mechanism shown in FIGS. 10 and 17. In this open limit condition shown schematically in FIG. 17, the hatch stops 68 are withdrawn from within by-pass chute 36 so that hatch 63 can attain the fully open orientation that is illustrated in FIG. 10 for example.

An electrically actuatable solenoid provides an alternative embodiment of the hatch stop 68 and actuator mechanism. In this regard, the entire disclosure of commonly owned U.S. application Ser. No. 10/012,373 is hereby incorporated herein by this reference.

A sensor is provided to signal each event constituting insertion of a certain threshold amount of trash that passes through the by-pass chute 36. Such threshold trash insertion causes the hatch 63 to tip into the by-pass chute 36 as shown in FIG. 11 and then return to the closed position shown in FIG. 11. As embodied herein and shown in FIGS. 10 and 11, a magnetic proximity sensor 75 is disposed in the vicinity of the entrance 37 to the by-pass chute 36. As shown in FIG. 11, a magnet 80 is mounted on a counterflange 70 portion of the hatch 63 so that the hatch sensor 75 detects the presence of the magnetic field projected by the magnet 80 when the hatch 63 is in the closed position. As shown in FIG. 10, the location of the magnet 80 on the counterflange 70 portion of the hatch 63 is such that movement of the hatch 63 into the by-pass chute 36 removes the hatch sensor 75 from the influence of the magnetic field of magnet 80. Thus, when the hatch 63 moves into the by-pass chute 36, the hatch sensor 75 is triggered and generates an electrical signal that is transmitted to the controller 76 through electrical leads, which are shown schematically in FIG. 19. When the hatch 63 moves out of the by-pass chute 36 and resumes the closed position shown in FIG. 11, the hatch sensor 75 is again triggered and generates another electrical signal that is received by the controller 76. The hatch sensor 75 is configured and disposed relative to the disposition of the magnet 80 for detecting an event that includes more than slight movement of the hatch 63 with respect to said entrance 37 of the by-pass chute 36. The controller 76 can be programmed to initiate a compaction and retraction cycle for the compacting mechanism upon receiving signals from the hatch sensor 75 indicating a predetermined number of trash insertion events.

As shown in FIGS. 8, 9, 10 and 11, the hatch sensor 75 is desirably disposed at a location that enables the hatch sensor 75 to sense the presence or absence of the hatch 63 and send a commensurate signal to the controller 76 through electrical leads, which are shown schematically in FIG. 19. When the controller 76 senses a signal from the hatch sensor 75, this can indicate that the hatch 63 is positioned above the hatch stop 68 member at the entrance of the by-pass chute 36 as shown in FIGS. 8, 9 and 11 for example. When the hatch sensor 75 fails to sense the presence of the magnet 80, then the hatch 63 is disposed so that it is tilted into the by-pass chute 36 during a trash disposal event, such as shown in FIG. 10 for example. Thus, the hatch sensor 75 and magnet 80 provide a device that monitors when the hatch 63 is positioned above the hatch stop 68 at the entrance of the by-pass chute 36.

Another sensor is provided to detect whether the door 26 that governs access into the lower portion 16 of the housing 13 (and any trash receptacle 27 contained therein) is open or locked in the closed position. As embodied herein and shown in FIGS. 4, 5 and 8 for example, an electronic switch 91*a* can be disposed within the portion of the frame 33 that butts against one edge 34 of the door 26 in the vicinity of the access opening 25. In the embodiment shown, switch 91*a* is located below where the threaded bolt 24 mates with the threaded opening 24*a*. Switch 91*a* is disposed so that when door 26 is closed and the locking mechanism is engaged, then switch 91*a* detects the presence of door 26 in the closed and locked position and transmits this condition to the controller 76 through electrical leads, which are shown schematically in FIG. 19. When the door 26 closes and bolt 24 is threaded into the threaded opening of nut 24*a*, door 26 engages switch 91*a*. In this way, locking the door 26 in the closed position changes the condition of switch 91*a*. This change in the condition of switch 91*a* (from on to off or from off to on) is transmitted to the controller 76, which is preprogrammed to recognize that the door 26 is closed. Though the switch 91*a* is mounted to the frame in the embodiment shown, the opposite arrangement (switch 91 mounted to the door 26) can be employed. When the door 26 moves out of contact with frame 33, the condition of switch 91*a* is again changed, and this new condition is transmitted to and recognized by the controller 76. If desired, the controller 76 can be programmed desirably to prevent the initiation of a compaction and retraction cycle for the compacting mechanism upon recognizing that switch 91*a* is in a condition indicating that door 26 is not closed and locked.

The compacting mechanism includes a control device that automatically operates the compacting mechanism to compact the trash that is thrown into the trash can 12 of the present invention. As embodied herein and shown schematically in FIG. 19 for example, the control mechanism desirably is provided in the form of a programmable controller 76 or computer and can include a hydraulic fluid pump 79, an electric motor 54 that powers the pump 79, a non-contact, magnetic proximity sensor 75 of the position of the hatch 63, an upper carriage sensor 92*a*, a lower carriage sensor 92*b*, a pair of magnets 80, 93, a door closure sensor 91*a*, and an A/C power interrupt switch 91*b*.

FIG. 19 schematically shows the hydraulic pressure lines that constitute the hydraulic circuit and the electrical connections. The hydraulic fluid conduits are shown by the thicker lines, and electrical connecting wires are shown by the thinner lines. The valves are schematically represented according to American National Standards Institute (ANSI) format. As schematically shown in FIG. 19, a four-way directional solenoid valve 81 is disposed in the path of hydraulic lines 84, 85 that are connected between the hydraulic rams 50, 51 and the hydraulic reservoir 53 and pump 79. The four-way directional solenoid valve 81 can be configured in one of two alternative settings of the path of the fluid flow through the valve. The controller 76 can change the flow path configuration of valve 81 from one setting to the other setting by activating or de-activating the solenoid. When valve 81 is configured in the setting shown in FIG. 19, operation of the pump 79 causes the hydraulic fluid to flow into the chambers of the dual acting cylinders that results in the retraction of the pistons 50*a*, 51*a* toward and into the respective cylinders 50*b*, 51 *b* to produce the retraction stroke of the compacting mechanism. When valve 81 is configured in the alternative setting to the one that is shown in FIG. 19, operation of the pump 79 causes the hydraulic fluid to flow into the chambers of the dual acting cylinders that results in the extension of the pistons 50*a*, 51*a* away from and out of the respective cylinders 50*b*, 51*b* to produce the compaction stroke of the compacting mechanism.

As schematically shown in FIG. 19, the hydraulic circuit includes a return blocking valve 82 that is disposed in the hydraulic line 77 leading from the four-way solenoid valve 81 to the chambers of the cylinders 50*b*, 51 *b* that cause the respective pistons 50*a*, 50*b* to extend out of the cylinders 50*b*, 51 *b* when pressurized and filled with hydraulic fluid. The return blocking valve 82 is designed to allow hydraulic oil from the rod side of the cylinder to pass through the manifold block and be directed back to the pressure side of the cylinder without having to go back through the reservoir 53 and pump 79. This is for higher speed with little pressure resistance, to quickly extend the hydraulic ram to its working position where it encounters resistance, and then goes into slow speed, high pressure to complete its compaction cycle.

As schematically shown in FIG. 19, the hydraulic circuit includes a pressure relief valve 83 that is disposed across hydraulic lines 84, 85 and between the four-way solenoid valve 81 and the hydraulic reservoir 53 and pump 79. The pressure relief valve 83 is designed to hold hydraulic working pressure at a predetermined setting, which is determined by the hydraulic pressure [850 psi+/−50 psi] that is needed to give the desired force [1250 lbs] to the platen. About 1250 lbs of force is needed to compact the trash to a mass that is approximately 1/12 to 1/15 times its original volume and that weighs about 40 to 50 lbs. Any excess pressure generated by the pump 79 is routed back to the reservoir 53. If the ram is stopped (i.e., end of stroke, backpressure build up of trash) the excess pressure is routed back to the reservoir 53.

As schematically shown in FIG. 19, the hydraulic circuit includes a regenerative switching valve 86 that is disposed in the hydraulic line 78 leading from the four-way solenoid valve 81 to the chambers of the cylinders 50*b*, 51 *b* that cause the respective pistons 50*a*, 50*b* to retract into the cylinders 50*b*, 51*b* when pressurized and filled with hydraulic fluid. The function of the regenerative switching valve 86 is to aid the return blocking valve 82 by keeping the unloaded low pressure hydraulic oil routed through the check valve 112 and through the return blocking valve 82 for the high speed, low pressure movement, of the hydraulic cylinder advancement. This valve 86 also directs hydraulic oil toward the rod end of the hydraulic cylinder during the retraction cycle.

As schematically shown in FIG. 19, the hydraulic circuit includes a check valve 112 that is disposed between hydraulic line 78 and the return blocking valve 82. The function of the check valve 112 is to prevent backflow of hydraulic fluid from hydraulic line 77 through return blocking valve 82 and into hydraulic line 78.

As schematically shown in FIG. 19 for example, a switch 91*b* controls the provision of electrical power to the motor 54 that powers the hydraulic pump 79. When switch 91*b* is closed, power can be supplied to the motor 54 from the A/C power supply that is designated P in FIG. 19. As shown in FIGS. 4, 5 and 8 for example, A/C power interrupt switch 91*b* is desirably a push-button switch that is mounted in the frame 33 that opposes one edge 34 of the door 36 so that switch 91*b* is depressed and closed when the door 26 is closed and the bolt 24 is screwed into the threaded opening 24*a*. However, when the door 26 is opened, the switch 91*b* is released and opens the electrical circuit that provides power to the motor 54 and accordingly prevents the motor 54 from receiving electrical power and operating the pump 79 to supply hydraulic fluid to the rams 50, 51. Thus, the compacting mechanism becomes disabled when the door 26 is opened.

As schematically shown in FIG. 19, the controller 76 is electrically connected to control the electric motor 54 that powers the hydraulic fluid pump 79. The controller 76 is also electrically connected to control the flow path setting of the four-way directional solenoid valve 81. The controller 76 is electrically connected to receive monitoring signals from each of the upper and lower limit switches 92*a*, 92*b*, respectively. Additionally, the controller 76 is electrically connected to receive monitoring signals from each of the magnetic hatch sensor 75 and the door open switch 91*a*.

The controller 76 will attempt to initiate a compaction cycle when the controller 76 has received a predetermined number of signals generated by the magnetic hatch sensor 75. Each recorded signal from the hatch sensor 75 corresponds to a trash disposal passing through the by-pass chute 36. The predetermined number is chosen to predict when the trash that has fallen into the receptacle will need to be compacted. That predetermined number can be programmed into the controller 76 and can be varied depending on the type of trash that is anticipated.

As shown in FIGS. 10 and 11 for example, the hatch sensor 75, which is a type of proximity sensor, is disposed at a location that enables the hatch sensor 75 to sense the presence or absence of the hatch 63. When the controller 76 has recorded the predetermined number of signals from the hatch sensor 75, then the controller 76 checks the hatch sensor 75. When the hatch sensor 75 senses the absence of the hatch 63, it means that the hatch 63 is disposed so that it is tilted into the by-pass chute 36 during a trash disposal event such as shown in FIG. 10. It is undesirable for a compaction stroke to be initiated under this circumstance because it would be possible for a user's hand to be inserted through the by-pass chute 36. Thus, the controller 76 is desirably programmed so that only when the controller 76 senses a signal from the hatch sensor 75 indicating the presence of the hatch 63, meaning that the hatch 63 is positioned above the hatch stop 68 at the entrance of the by-pass chute 36, will the controller 76 activate the compacting mechanism to begin the compaction stroke. In this way, the hatch 63 effectively closes the by-pass chute 36 before the controller 76 initiates the compaction stroke. This programming of the controller 76 provides a safety measure that prevents the user's hand from being put into the by-pass chute 36 during the compacting cycle. This programming of the controller 76 also has the effect of preventing further trash above a certain size from passing through the by-pass chute 36 while the compacting cycle is being performed by the compacting mechanism.

Before the controller 76 initiates the compaction stroke, the controller 76 also checks the condition of switch 91*a* that senses whether the door 26 is open or closed and locked. The compaction sequence will not be initiated unless controller 76 detects that the door 26 is closed and locked.

As schematically shown in FIG. 19, the controller 76 is programmed to then send a signal to the four-way directional solenoid valve 81 to energize the valve 81. Energizing the valve 81 configures the hydraulic circuit so that the flow of hydraulic fluid can be pumped into the appropriate chambers of the hydraulic rams 50, 51 that results in the extension of the pistons 50*a*, 51*a* out of the respective cylinders 50*b*, 51*b*. The four-way directional solenoid valve 81 is configured so that when the controller 76 turns on the electric motor 54 to operate the pump 79, then hydraulic fluid flows into the chambers of the dual acting cylinders 50*b*, 51*b* that result in the extension of the pistons 50*a*, 51*a* away from and out of the respective cylinders 50*b*, 51*b* to produce the compaction stroke of the compacting mechanism. Once the four-way valve 81 is appropriately configured, the controller 76 switches the motor 54 on and the pump 79 begins to withdraw hydraulic fluid out of the reservoir 53 via hydraulic line 87 and begins to pump hydraulic fluid into the rams 50, 51 via hydraulic line 85. The pistons 50*a*, 51*a* in the rams 50, 51 begin to extend the rams to produce the compaction stroke of the compacting mechanism as in FIGS. 2, 3, 14 and 18 for example. The platen then moves away from the upper portion 14 of the housing and toward the lower portion 16 of the housing as shown in FIGS. 8, 9 and 17 for example. Because both pistons 50*a*, 51*a* extend simultaneously, it only takes about four seconds for the full extension of the pistons 50*a*, 51*a* out of the respective reams 50, 51.

After the elapse of about four seconds from the initiation of the compaction stroke, the controller 76 then de-energizes the four-way valve 81, which reconfigures the four-way valve 81 to its default condition for the retraction stroke. This reconfiguration results in the arrangement that is schematically illustrated in FIG. 19 for example. The motor 54 continues to run the pump 79 to drive the retraction stroke of the compacting mechanism. Thus, a single compacting cycle, consisting of a compaction stroke and a retraction stroke, has been performed.

A typical operation cycle of a presently preferred embodiment of the trash can of the invention now will be described. Trash can be tossed onto the top wall 19 of the housing 13 or into the trash opening 20 defined through the top 17 of the housing 13. The trash moves under the force of gravity down the incline of the top wall 19 toward the trash opening 20 and eventually through the funnel 23 and into the trash opening 20 connected to the funnel 23.

The trash next encounters the upper surface of the hatch 63, which is counterbalanced and pivots into the by-pass chute 36 to allow the trash to enter the by-pass chute 36 through the entrance 37 thereof. The trash passes through the by-pass chute 36 and flows out of the exit 38 at the opposite end of the by-pass chute 36, through the intermediate portion 15 and into the lower portion 16 of the housing 13. In those embodiments wherein a trash receptacle 27 is disposed in the lower portion 16 of the housing, the trash falls into and is collected in the trash receptacle 27.

Each time the hatch 63 tilts into the by-pass chute 36 to permit trash to pass through, the magnetic hatch sensor 75 generates a signal that is transmitted to the controller 76. Each such signal corresponds to a trash insertion event in which trash is admitted into the trash can and falls down to the hatch 63 and drops through the by-pass chute 36. When the controller's event counter is in the active mode, the controller 76 is programmed to activate the compacting mechanism upon receipt of a predetermined number of signals from the hatch sensor 75. When controller 76 receives this number of signals from the hatch sensor 75, the controller 76 is programmed to switch the controller's trash event counter into the inactive mode, thus suspending the recording and counting further trash event signals from the hatch sensor 75.

Before activating the compacting mechanism, the controller 76 checks the state of the hatch sensor 75 that detects the position of the hatch 63 to be sure that the hatch 63 assumes the closed position such as shown in FIG. 11 for example. If the hatch sensor 75 indicates that the hatch 63 is in the closed position, the controller 76 then checks the condition of sensor 91*a* to determine that the door 26 is closed and locked. Assuming that the door 26 is closed and locked, then controller 76 activates the compacting mechanism to initiate the compaction stroke, which is partially illustrated successively in FIGS. 2, 3, 17 and 18 for example. This operation of the compaction and retraction stroke has been explained above.

As schematically shown in FIG. 2, as the extendable member that carries the platen moves downwardly during the compaction stroke, the lower plate 45*b* of the telescoping wall 45 slides away from the upper plate 45*a*. Additionally, the pivotable portion 42 of the platen moves from the orientation shown in chain-dashed line in FIG. 2 to the orientation shown in solid line wherein the platen is fully extended and covers substantially the entire width of the opening defined by the upper peripheral edge 52 of trash receptacle 27. Eventually, the platen is moved into a position shown for example in FIG. 3 wherein the platen applies the compacting pressure to the contents of the trash receptacle 27.

During the retraction stroke, the compacting mechanism retraces the steps successively shown in FIGS. 2, 3, 17 and 18 and eventually attains the fully retracted orientation shown in FIGS. 9 and 17 for example. Along the way, the force of the hydraulic rams 50, 51 overcomes the tension in the resilient spring 58 as the roller 55 engages the cam 74 on pivotable portion 42 of the platen and folds the pivotable portion 42 downwardly (chain-dashed line in FIG. 2) to enable the platen to move past the by-pass chute 36 as the extendable member moves toward the upper portion 14 of the housing. Whereupon the upward movement of the cylinder 51*b* engages the cam follower 107 to rotate the rod 103 and spool 100 as shown in FIG. 17 so as to withdraw the hatch stop 68 out of the by-pass chute 36 as shown in FIG. 11 to thereafter permit the hatch 63 to be pivoted into the by-pass chute 36 to allow passage of trash through the by-pass chute 36 and into the lower portion 16 of the housing.

Eventually, the trash receptacle 27 will become full, and it will become necessary to alert the attendant to open the door 26 in the side of the lower portion 16 of the housing 13 and withdraw the compacted trash in the trash receptacle 27 from the trash can 12 and transport the compacted trash to a central collection site for further disposal of the trash. To this end, the controller 76 is desirably programmed so that upon receiving one or more predetermined signals from a detection device, the controller 76 will assume that the trash receptacle 27 is full and should be emptied.

In accordance with the present invention, a device for detecting when the trash can is full includes a non-contact magnetic sensor that is disposed and configured for detecting during each compaction stroke of the platen, an event that includes movement of the platen through a compaction stroke that is less than a predetermined minimum distance. As embodied herein and shown schematically in FIGS. 9 and 14 for example, the detection device desirably includes a pair of non-contact magnetic sensors 92*a*, 92*b* that are mounted on one of the side rails 30 of the frame. Desirably, the vertical position of each magnetic sensor 92*a*, 92*b* can be adjusted by loosening the respective nut 90*a*, 90*b* shown in FIG. 9 to permit movement at the respective slide 89*a*, 89*b*, which moves within a respective vertically disposed, elongated slot 39*a*, 39*b* that is provided through the side rail 30 of the frame. As schematically shown in FIG. 19, magnetic sensors 92*a* and 92*b* are electrically connected to the controller 76.

As shown schematically in FIG. 14 for example, the detection device includes a magnet 93 that is mounted on one of the side bars 41 of the carriage that moves past the side rail 30 on which the magnetic sensors 92*a* and 92*b* are mounted. The magnet 93 provides a magnetic field that triggers each magnetic sensor 92*a* and 92*b* to generate a signal that is sent to the controller 76 when the sensor 92*a* or 92*b* detects a change in the local magnetic field as would occur when the magnet 93 moves past or away from the sensor 92*a* or 92*b*. Thus, each movement of the platen, which is carried by the carriage that includes the side bar 41 that carries the magnet 93, triggers the upper magnetic sensor 92*a* to generate a first signal that is received by the controller 76 when magnet 93 moves downwardly away from upper magnetic sensor 92*a*. Similarly, lower magnetic sensor 92*b* is triggered to generate a second signal that is received by the controller 76 when magnet 93 moves downwardly past lower sensor 92*b*.

Depending upon the height at which lower sensor 92*b* is disposed in the lower slide 89*b*, at some point, enough compacted trash will have accumulated so that during the compaction stroke, the magnet 93 never descends to the level at which lower sensor 92*b* will detect the magnetic field of magnet 93. The compaction stroke falls short of a predetermined distance that depends on the location of the lower sensor 92*b*. Thus, lower sensor 92*b* will not be triggered to send a signal to the controller 76. However, upper magnetic sensor 92*a* will always be triggered when the platen moves from the uppermost configuration shown in FIG. 17 for example, toward the lower portion 16 of the housing 13. Thus, when the controller 76 receives a signal from upper sensor 92*a* but does not receive a signal from lower sensor 92*b*, the controller 76 is programmed to recognize this condition as meaning that the trash can is full and needs to be emptied.

Upon detecting this trash full event, the controller 76 is configured to energize the four-way valve 81 and run the motor 54 and pump 79 for a few milliseconds to ensure that the cam follower 107 is released from being pinned against the inner surface 35 of the top rail 31 as shown in FIG. 18 for example so that the hatch stops 68 are deployed inside the by-pass chute 36 to prevent the hatch 63 from opening. The controller-76 also signals the attendant by illuminating the signaling lights 111 that are mounted on the upper portion 14 of the housing as shown in FIG. 1 for example. The illumination of signaling lights 111 indicates that the desired amount of trash has become compacted in the lower portion 16 of the housing 13 such that the attendant should empty the trash can. When the controller 76 records this condition of a "full" trash can, the controller 76 is desirably programmed to disable the compacting mechanism by refraining from signaling the motor 54 to operate the hydraulic pump 79.

Referring to FIG. 4, when the attendant opens the door 26 to gain access to the receptacle 27 for the purpose of emptying the accumulated trash, both switches 91*a* and 91*b* change their conditions. Opening the door 26 causes the A/C power interrupt switch 91*b* to disconnect the motor 54 from the power supply that is designated P in FIG. 19. This condition prevents the trash compacting mechanism from operating, even if the controller 76 were to send a signal to the motor 54 to begin operation. Opening the door 26 also causes the door open switch 91*a* to signal the controller 76 that the door 26 has been opened. The controller 76 is programmed to wait for a predetermined time from the receipt of the signal from switch 91*a* indicating that the door 26 has been opened and then to switch the controller's trash event counter back to the active mode and resume recording trash event signals from the hatch sensor 75.

After the attendant has emptied the receptacle 27 of trash and replaced the receptacle 27 on the floor 16*a* in the lower portion 16 of the housing 13, the attendant closes and locks the door 26. When the door is locked, both switches 91*a* and 91*b* once again change their conditions from open to closed. As shown in FIG. 19 for example, when switch 91*b* is closed, power can be supplied to the motor 54. When switch 91*a* is closed, it sends a signal to the controller 76 indicating that the door 26 has be closed and locked. The controller 76 is programmed so that the controller will not activate the compacting mechanism unless this door detection switch 91*a* indicates that the door 26 is closed and locked. The controller 76 is configured to de-energize the four-way valve 81 and run the motor 54 and pump 79 for a few milliseconds to ensure that the cam follower 107 is pinned against the inner surface 35 of the top rail 31 as shown in FIG. 17 for example so that the hatch stops 68 are withdrawn from the inside of the by-pass chute 36 to allow the hatch 63 to open. At his point, the trash can 12 is reset to resume compacting the trash that is deposited into the opening 20.

In accordance with another aspect of the present invention, a method is provided for molding a message or other graphics into a display panel that is provided as part of a molded item such as the housing of a trash can for example. In this case, the display panel 19*a* includes characters composing a desired image, such as the letters spelling "TRASH," and the characters are embedded in the display panel. This method desirably can be used to mold any portion of the housing 13 where signage or graphics are to be displayed to passersby. For example, the message "TRASH" could be provided in the display panel 19*a* formed in the top wall 19 of housing 13 or in the sidewall 18 of the housing 13 shown in FIG. 1.

Figures 20A, 20B, 20C, 20D, 20E, 20F, 20G, 20H, 20I:
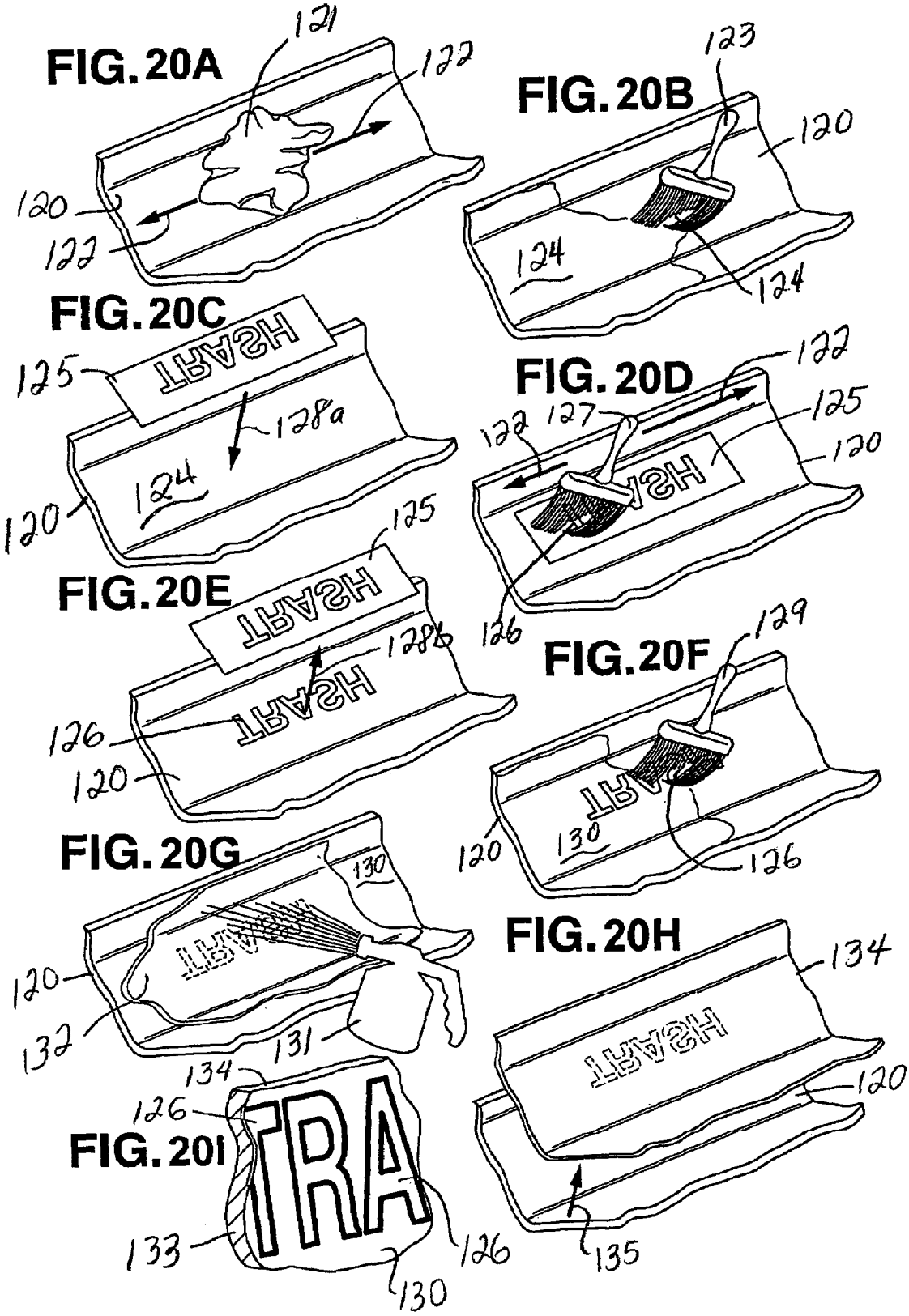
FIG. 20 is a schematic view of steps of a method in accordance with a presently preferred embodiment of the present invention.

The upper portion 14 of housing 13 desirably can be formed from fiberglass that is shaped in a mold. As shown in FIG. 20A, a portion of the mold defines a substrate 120 that is shaped according to the desired shape of the display panel. Once the mold is provided, the substrate is subjected to cleaning, which is schematically shown in FIG. 20A by the cleaning cloth 121 that moves back and forth in the directions of the arrows 122. The method next includes applying a standard mold release agent to the mold. This step is schematically shown in FIG. 20B, by the brush 123 applying the release agent 124 to the substrate 120.

Once at least the substrate portion 120 of the mold has been so prepared with the mold release agent 124, the next step involves installing an adhesive-backed stencil 125 on the substrate, which is the desired location for the display panel 19*a* in the finished product. The stencil 125 is laid down with the characters (such as lettering) in reverse form. This step is schematically shown in FIG. 20C in which the laying down of the stencil 125 is schematically indicated by the arrow designated 128*a*. Thus, the characters in the stencil 125 are outlined as a mirror image (reversed) from the characters that are desired to form the ultimate image. The adhesive on the stencil 125 functions to seal the edges of the characters in order to prevent bleeding of the image past the borders of the stencil that would yield an image having an outline that was not well defined. However, depending upon artistic taste, in some embodiments, the less than well defined outline might be deemed artistically and aesthetically desirable. In such a case, it is not necessary to use a stencil 125 that has an adhesive backing.

Once the stencil 125 is installed against the substrate, the next step of the method calls for applying a gel coat to fill the voids in the stencil 125 that form the desired characters to be shown in the image of the display panel 19*a*. The gel coat is applied to the area bounded by the stencil 125. This application coat of gel 126 is schematically indicated in FIG. 20D by the brush 127 that moves back and forth in the direction of arrows 122. Then the stencil 125 is removed from the substrate, leaving only the applied gel 126 in the form of the reverse of the desired image on the substrate 120. This stencil removal step is schematically indicated in FIG. 20E by the arrow designated 128*b*. Then a coat of gel in a contrasting color is applied to the substrate to fill in the gaps around the image. As shown in FIG. 20F, a brush 129 schematically represents the application of the contrasting gel coat 130 on top of the gel 126 and the substrate 120 of the mold. However, the contrasting gel coat 130 can be applied by spraying as well as by brushing, whichever is desired.

From this point, the remaining steps in the method use the standard process for forming a molded fiberglass item. As shown in FIG. 20G, a sprayer 131 schematically represents the application of the fiberglass and resin 132 on top of the gel 130 and the substrate 120 of the mold. These fiberglass application steps are followed until the desired thickness of fiberglass 133 has been created within the mold. Then the molded item 134 is removed from the substrate 120, leaving only the applied gel 126 in the form of the desired image on the substrate 120. This step of removing the molded item 134 from the substrate 120 of the mold is schematically indicated in FIG. 20H by the arrow designated 135. When the molded item 134 is removed from the mold, the desired image will be visible and formed by the stenciled coat of gel 126 surrounded by the contrasting coat of gel 130 and embedded as part of the fiberglass article. This condition is schematically indicated in FIG. 201. Thus, the image will not deteriorate despite applications of cleanser during normal maintenance of the exterior of the housing 13 of the trash can 12.

What is claimed is:

1. An apparatus for receiving a variety of different types of consumer trash in high traffic public areas and compacting the received trash together into a compacted mass, comprising:

a housing, said housing including a top and a side wall connected to said top, said housing having an upper portion, a lower portion disposed beneath said upper portion, and an intermediate portion disposed between said upper portion and said lower portion;

a trash opening defined through said top;

a frame disposed within said housing;

a trash by-pass chute disposed within said housing and having an entrance aligned generally with said trash opening, said by-pass chute having an exit disposed to empty into said lower portion of said housing;

a compacting mechanism carried by said frame and including a platen, said compacting mechanism being configured for moving said platen through a compaction stroke to apply compacting pressure to trash contents located in said lower portion of said housing during at least a portion of said compaction stroke;

a hatch disposed to control physical access through said trash by-pass chute, said hatch being configured to selectively pivot between a closed orientation substantially blocking access through said trash by-pass chute and an open orientation substantially permitting access through said trash by-pass chute;

a hatch stop disposed at said entrance of said trash by-pass chute;

an actuator mechanism connected to said hatch stop, said actuator mechanism being configured to selectively actuate said hatch stop to hold said hatch in said closed orientation with respect to said trash by-pass chute; and said actuator mechanism including a cable spool rotatably mounted to said frame, a cable having one end connected to said spool and an opposite end connected to said hatch stop.

2. An apparatus as in claim 1, wherein:

said compacting mechanism including a selectively variable length ram; and said actuator mechanism including a cam follower connected to said spool so as to rotate when said spool rotates, said cam follower being rotatably mounted to said frame and configured and disposed to be rotated by selective engagement with said ram.

3. An apparatus as in claim 2, wherein:

said cam follower being automatically disposed to a position during operation of said compacting mechanism such that said actuator mechanism actuates said hatch stop to said closed orientation whereby said hatch is substantially blocking access through said trash by-pass chute.

4. An apparatus as in claim 3, wherein said actuator mechanism includes at least one spring connected so as to bias said hatch stop in a position where said hatch is disposed in said closed orientation.

5. An apparatus as in claim 1, wherein said hatch defines a front section and an adjacent section contiguous with said front section, said front section residing in a plane that forms an obtuse angle with the plane of said adjacent section, said front section having a free edge pointing toward said exit of said trash bypass chute.

6. An apparatus as in claim 1, wherein said compacting mechanism includes an extendable member having a pair of opposed ends, said platen defining a first portion connected to one said end of said extendable member, said platen defining a pivotable portion pivotally connected to said first portion of said platen; and wherein said pivotable portion of said platen defines a front section and an adjacent section contiguous with said front section, said front section residing in a plane that forms an obtuse angle with the plane of said adjacent section, said front section having a free edge pointing away from said exit of said trash bypass chute.

7. An apparatus as in claim 6, wherein said compacting mechanism is configured for moving said platen through a retraction stroke to reposition said platen away from said lower portion of said housing during at least a portion of said retraction stroke and said compacting mechanism is further configured so that said pivotable portion of said platen pivots away from said top of said housing during at least a portion of said retraction stroke.

8. An apparatus as in claim 1, wherein said compacting mechanism being configured for moving said platen through a retraction stroke to reposition said platen away from said lower portion of said housing during at least a portion of said retraction stroke and said platen is configured to by-pass said trash by-pass chute during at least a portion of said retraction stroke.

9. An apparatus as in claim 1, further comprising:

a controller disposed within said housing; and a non-contact magnetic sensor disposed within said housing and configured for detecting an event that includes more than slight movement of said hatch with respect to said entrance of said by-pass chute, said sensor being connected to said controller and configured to generate a signal that is transmitted to said controller upon detection of said event, said controller being configured to activate said compacting mechanism after receiving from said sensor, signals that indicate the occurrence of a predetermined number of events.

10. An apparatus as in claim 1, further comprising:

a controller disposed within said housing; and a non-contact magnetic sensor disposed within said housing and configured for detecting during each compaction stroke of said platen, an event that includes movement of said platen through a compaction stroke that is less than a predetermined minimum distance, said sensor being connected to said controller, said controller being configured to refrain from activating said compacting mechanism after detection of such event.

11. An apparatus as in claim 10, further comprising:

a sensor mount, said sensor mount carrying said non-contact magnetic sensor and connected to said frame, said sensor mount being configured for selective positioning along said frame.

12. An apparatus as in claim 1, further comprising:

a controller disposed within said housing;

an access opening defined through said lower portion of said housing;

a door defining a section of said lower portion of said housing and configured to selectively open and close said access opening;

a power source connected to said compacting mechanism for providing power to operate said compacting mechanism; and a switch connected between said power source and said compacting mechanism and configured and disposed to detect at least when said door is disposed to close said access opening.

13. An apparatus as in claim 12, wherein said switch is configured so that upon failing to detect that said door is disposed to close said access opening, said switch operates to disconnect said power source from said compacting mechanism.

* * * * *